US009108076B2

(12) United States Patent
Sigelaksis

(10) Patent No.: US 9,108,076 B2
(45) Date of Patent: Aug. 18, 2015

(54) FIRE HYDRANT LOCKING SPRINKLER CAP, HYDRANT VALVE SEALS AND LUBRICATION ACCESS

(75) Inventor: George Sigelaksis, East Rockaway, NY (US)

(73) Assignee: Sigelock Systems, L.L.C., East Rockaway, NY (US)

( * ) Notice: Subject to any disclaimer, the term of this patent is extended or adjusted under 35 U.S.C. 154(b) by 647 days.

(21) Appl. No.: 13/163,627

(22) Filed: Jun. 17, 2011

(65) Prior Publication Data

US 2011/0308824 A1 Dec. 22, 2011

Related U.S. Application Data

(60) Provisional application No. 61/356,427, filed on Jun. 18, 2010.

(51) Int. Cl.

| | |
|---|---|
| ***A62C 35/20*** | (2006.01) |
| ***E03B 9/02*** | (2006.01) |
| ***E03B 9/06*** | (2006.01) |

(52) U.S. Cl.

CPC . *A62C 35/20* (2013.01); *E03B 9/02* (2013.01); *E03B 9/06* (2013.01)

(58) Field of Classification Search

CPC ..... E03B 9/02; E03B 9/06; A62C 35/20
USPC ..... 137/15.02, 296
See application file for complete search history.

(56) References Cited

U.S. PATENT DOCUMENTS

| | | | |
|---|---|---|---|
| 468,781 | A | 2/1892 | Brentano |
| 468,782 | A | 2/1892 | Brentano |
| 556,500 | A | 3/1896 | Fox |
| 695,147 | A | 3/1902 | Denney |
| 736,934 | A | 8/1903 | Carlson |
| 969,776 | A | 9/1910 | Foley |
| 978,385 | A | 12/1910 | Lotton |
| 1,199,297 | A | 9/1916 | Obeda |
| 1,229,429 | A | 6/1917 | Farley |
| 1,278,487 | A | 9/1918 | Lotton |

(Continued)

FOREIGN PATENT DOCUMENTS

| | | |
|---|---|---|
| DE | 0683937 | 11/1939 |
| DE | 0813525 | 9/1951 |

OTHER PUBLICATIONS

PCT International Search Report—PCT/US 2011/037470 (Sep. 28, 2011) 3 pages.

(Continued)

*Primary Examiner* — Len Tran
*Assistant Examiner* — Viet Le
(74) *Attorney, Agent, or Firm* — Martine Penilla Group, LLP

(57) ABSTRACT

A method for delivering water through a fire hydrant is described. The method includes unlocking a sprinkler cap control lock on the fire hydrant, removing the sprinkler cap control lock to access the operating nut of the fire hydrant and activating the operating nut to deliver water through the sprinkler ports in at least one cap on the fire hydrant. A fire hydrant with a sprinkler cap having a plurality of sprinkler ports and a sprinkler cap control lock, wherein the sprinkler cap control lock covers and prevents access to the operating nut is also described. Systems and methods for lubricating the operating nut and for improved sealing surfaces in the fire hydrant valves are also described.

20 Claims, 28 Drawing Sheets

(56) References Cited

U.S. PATENT DOCUMENTS

| | | | | | |
|---|---|---|---|---|---|
| 1,708,395 | A | | 4/1929 | Muller | |
| 1,828,763 | A | | 10/1931 | Carnes | |
| 2,019,393 | A | | 10/1935 | George | |
| 2,146,968 | A | | 2/1939 | Macagno | |
| 2,436,016 | A | | 2/1948 | Myers | |
| 2,465,727 | A | | 3/1949 | James | |
| 2,489,787 | A | * | 11/1949 | Knowlton | 220/203.08 |
| 2,699,176 | A | | 1/1955 | Ucciardi | |
| 2,869,576 | A | | 1/1959 | Kennedy | |
| 2,882,774 | A | | 4/1959 | Guttfeld | |
| 3,091,356 | A | | 5/1963 | Simpkins | |
| 3,151,756 | A | | 10/1964 | Gruen | |
| 3,185,171 | A | | 5/1965 | Mueller et al. | |
| 3,223,110 | A | | 12/1965 | Mueller et al. | |
| 3,379,209 | A | | 4/1968 | Spiselman | |
| 3,406,708 | A | | 10/1968 | Maydock | |
| 3,456,463 | A | | 7/1969 | Mihalich | |
| 3,532,109 | A | | 10/1970 | Smith | |
| 3,563,406 | A | | 2/1971 | Ferrante | |
| 3,572,786 | A | | 3/1971 | Dunton | |
| 3,623,498 | A | | 11/1971 | Manahan | |
| 3,626,961 | A | * | 12/1971 | Quinones | 137/296 |
| 3,742,162 | A | | 6/1973 | Wasemann | |
| 3,914,966 | A | | 10/1975 | Bello | |
| 3,973,687 | A | | 8/1976 | Glick | |
| 3,980,096 | A | | 9/1976 | Ellis et al. | |
| 3,980,097 | A | | 9/1976 | Ellis | |
| 4,033,372 | A | | 7/1977 | Bowman | |
| 4,062,375 | A | | 12/1977 | Byrnes | |
| 4,177,826 | A | | 12/1979 | Luckenbill | |
| 4,182,361 | A | | 1/1980 | Oakey | |
| 4,280,525 | A | | 7/1981 | Byrnes | |
| 4,303,223 | A | | 12/1981 | Whisenhunt et al. | |
| 4,461,597 | A | | 7/1984 | Laurin | |
| 4,484,595 | A | | 11/1984 | Vanek et al. | |
| 4,566,481 | A | | 1/1986 | Leopold, Jr. et al. | |
| 4,570,670 | A | | 2/1986 | Johnson | |
| 4,633,896 | A | | 1/1987 | Bainbridge et al. | |
| 4,716,922 | A | | 1/1988 | Camp | |
| 4,727,900 | A | | 3/1988 | Dooling et al. | |
| 4,736,765 | A | | 4/1988 | Campbell | |
| 4,791,952 | A | | 12/1988 | Laurel | |
| 4,827,969 | A | | 5/1989 | Lyasko | |
| 4,936,336 | A | | 6/1990 | McCauley et al. | |
| 5,033,501 | A | | 7/1991 | Stehling | |
| 5,094,265 | A | | 3/1992 | Jackson et al. | |
| 5,441,074 | A | | 8/1995 | Kjaer | |
| 5,549,133 | A | * | 8/1996 | Sigelakis | 137/296 |
| 5,690,242 | A | | 11/1997 | Campbell, Jr. | |
| 5,988,219 | A | | 11/1999 | Larsen | |
| 6,089,253 | A | | 7/2000 | Stehling | |
| 6,112,761 | A | | 9/2000 | Scotto | |
| 6,155,988 | A | | 12/2000 | Peters | |
| 6,561,214 | B2 | | 5/2003 | Heil | |
| 6,688,269 | B1 | | 2/2004 | Steinmetz | |
| 6,688,326 | B1 | | 2/2004 | Sigelakis | |
| 6,886,586 | B2 | | 5/2005 | Fleury | |
| 7,025,394 | B1 | | 4/2006 | Hunt | |

OTHER PUBLICATIONS

PCT ISR PCT/US1001672, dated Sep. 2, 2010, pp. 1-3.

* cited by examiner

FIRE HYDRANT LOCKING SPRINKLER CAP, HYDRANT VALVE SEALS AND LUBRICATION ACCESS

PRIORITY CLAIM AND CROSS REFERENCE TO RELATED APPLICATIONS

This application claims priority from U.S. Provisional Patent Application No. 61/356,427 filed on Jun. 18, 2010 and entitled "Fire Hydrant Locking Sprinkler Cap," which is incorporated herein by reference in its entirety for all purposes.

BACKGROUND

The present invention relates generally to fire hydrants and, more particularly, to a sprinkler cap, a lubrication system for the operating nut and improved seal systems and methods for a fire hydrant.

Firefighters need quick and reliable access to water to fight fires safely and effectively. Fire hydrants are often tampered with to provide water for recreational purposes such as spraying on the sidewalk or street on a hot summer day. Typical fire hydrants are susceptible to damage due to this tampering. Fire hydrants also often fail due to failed valve seals and seized operating nuts. Such damage and failures can prevent firefighters from accessing water via the fire hydrant when called upon to fight a fire.

In view of the foregoing, there is a need for a fire hydrant that has a locking sprinkler cap that can allow authorized personnel to easily access the fire hydrant to provide a water sprinkler. There is also need for a fire hydrant with improved seals and a fire hydrant with an operating nut that is easier to lubricate.

SUMMARY OF THE INVENTION

Broadly speaking, the present invention fills these needs by providing a fire hydrant including a locking sprinkler cap, a fire hydrant with improved seals and a fire hydrant with an operating nut that is easier to lubricate. It should be appreciated that the present invention can be implemented in numerous ways, including as a process, an apparatus, a system, or a device. Several inventive embodiments of the present invention are described below.

One embodiment provides a method for delivering water through a fire hydrant. The method includes unlocking a sprinkler cap control lock on the fire hydrant, removing the sprinkler cap control lock to access an operating nut of the fire hydrant and activating the operating nut to deliver water through a plurality of sprinkler ports in at least one of a plurality of caps on the fire hydrant.

The method can also include deactivating the operating nut to stop delivering water through the sprinkler ports in at least one of the plurality of caps on the fire hydrant. The method can also include installing the sprinkler cap control lock on the fire hydrant to prevent access to the operating nut of the fire hydrant and locking the sprinkler cap control lock on the fire hydrant.

Another embodiment provides a fire hydrant including a sprinkler cap having a plurality of sprinkler ports and a sprinkler cap control lock, wherein the sprinkler cap control lock covers and prevents access to an operating nut. The sprinkler cap can be a locking cap. The sprinkler cap control lock can also lock to a tongue in the locking cap. The sprinkler cap can be a side cap.

Another embodiment provides a fire hydrant including a fire hydrant body and an operating nut coupled to an operating stem. The operating nut includes a lubricant port, a top chamber and one or more side ports in fluid communication with the top chamber and a lubricant channel between the operating nut and the fire hydrant body.

The fire hydrant can also include an operating nut sleeve between the operating nut and the fire hydrant body. The fire hydrant can also include a first seal and a second seal between the operating nut and the fire hydrant body. The first seal can define an upper boundary to the lubricant channel and the second seal can define a lower boundary to the lubricant channel.

Yet another embodiment provides a method of lubricating a fire hydrant operating nut. The method includes accessing a lubricant port in the operating nut, connecting a lubricant source to the lubricant port, delivering pressurized lubricant through the lubricant port and into a top chamber inside the operating nut and through the top chamber to at least one side port, the at least one side port providing fluid communication between the top chamber and a lubricant channel between the operating nut and a fire hydrant body.

Accessing the lubricant port in the operating nut includes removing at least one access point for the locking cap. Removing at least one access point for the locking cap can include removing the locking cap. Removing at least one access point for the locking cap can include removing a sprinkler cap control lock.

Another embodiment provides a fire hydrant valve control device including a valve top plate, a valve bottom plate, a seat valve seal secured between the valve bottom plate and a bottom surface of the valve top plate, the seat valve seal having a sealing face that corresponds to a valve seat, wherein the seat valve seal is formed of a resilient material from one of a group consisting of an acetal polyoxymethylene copolymer, a polyethelyne oxide, a poly-dimethyl acetal resin, and a ultra-high-molecular-weight polyethylene.

The valve top plate can include a plurality of stabilizer arms that correspond to slots of a valve seat ring and wherein each of the plurality of stabilizer arms includes a replaceable insert of the resilient material.

Other aspects and advantages of the invention will become apparent from the following detailed description, taken in conjunction with the accompanying drawings, illustrating by way of example the principles of the invention.

BRIEF DESCRIPTION OF THE DRAWINGS

The accompanying drawings, which are incorporated in and constitute part of this specification, illustrate exemplary embodiments and together with the description serve to explain the principles of the invention, as claimed.

DETAILED DESCRIPTION

Several exemplary embodiments will now be described in detail with reference to the accompanying drawings.

Figure 1:
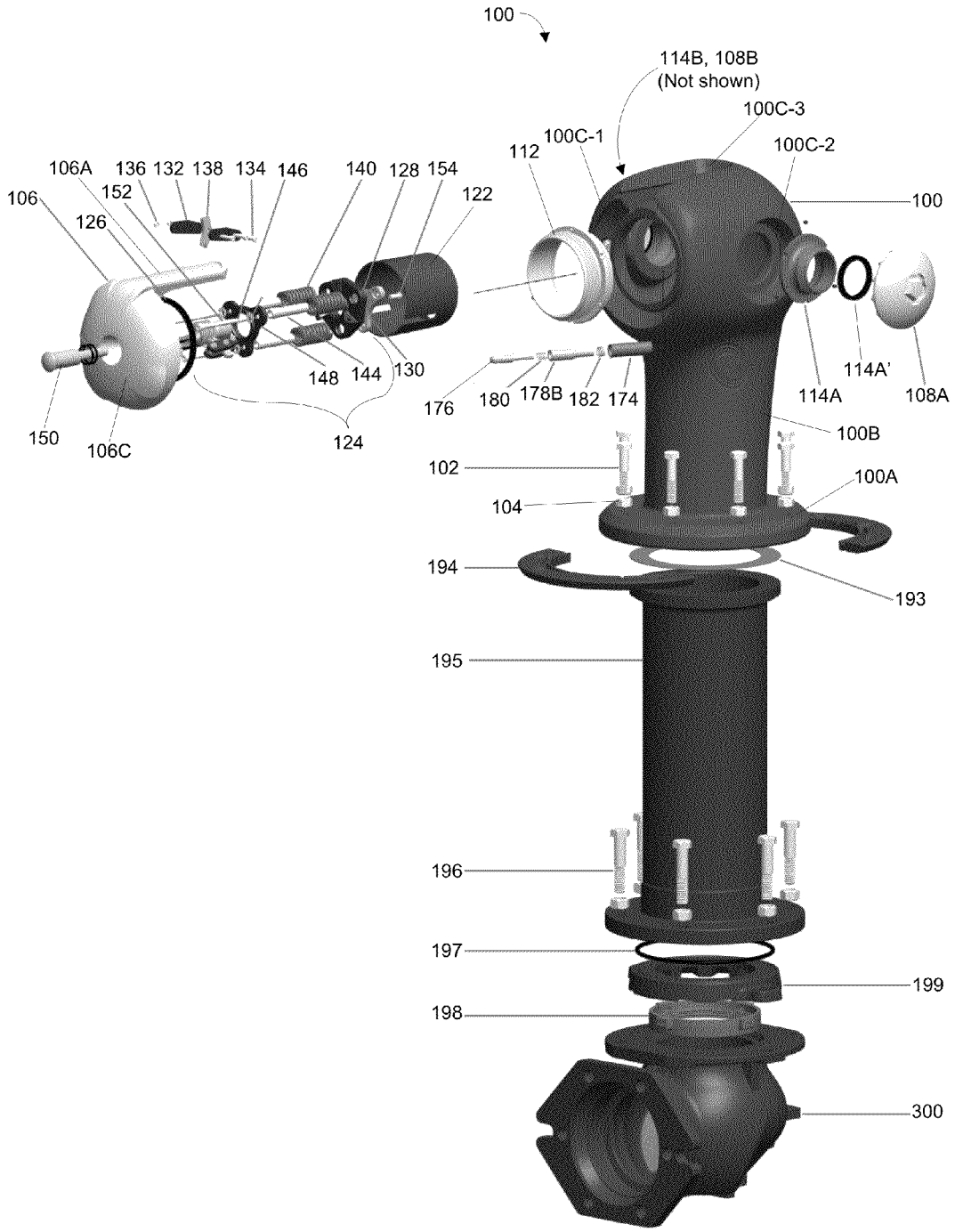
FIG. 1 is an exploded view of the components of a locking fire hydrant, standpipe and inlet elbow, in accordance with embodiments of the invention.

FIG. 1 is an exploded view of the components of a locking fire hydrant, standpipe and inlet elbow, in accordance with embodiments of the invention. As shown in FIG. 1, the locking fire hydrant includes a fire hydrant body 100, which is fastened to a standpipe 195 by bolts 102 and nuts 104. Locking cap 106 is mounted on fire hydrant body 100 to close off a main outlet port 112 defined in the fire hydrant body. Side caps 108A and 108B are mounted on fire hydrant body 100 to close off respective auxiliary side outlet ports 114A and 114B defined in the fire hydrant body. As used herein, the terms "side cap" and "auxiliary cap" are used interchangeably to refer to the cap used to close off an auxiliary outlet port defined in the fire hydrant body, i.e., any outlet port other than the main outlet port. Plunger assemblies 110A and 110B are provided in internal channels formed in fire hydrant body 100 on opposite sides of the main outlet port 112 defined in the fire hydrant body. When locking cap 106 is mounted on fire hydrant body 100, plunger assemblies 110A and 110B are actuated so that plungers extend into the recessed areas that surround the side outlet ports 114A and 114B defined in fire hydrant body 100. The plungers 110A and 110B interface with ratchet teeth formed on the back side of side caps 108A and 108B.

Also as shown in FIG. 1, fire hydrant body 100 includes flange 100A, neck 100B, and head 100C. Flange 100A has a plurality of holes formed therethrough and these holes are used to fasten the flange to a safety flange 194 using bolts 102 and nuts 104. The safety flange 194 captures seal 193 between the standpipe 195 and the flange 100A. As shown in FIG. 1, flange 100A is a generally circular flange that extends from the lower portion of neck 100B; however, it will be apparent to those skilled in the art that the configuration of the flange may be varied to meet the needs of particular situations. Fire hydrant body 100, as well as the other components of the locking fire hydrant described below, may be made of any suitable material, e.g., stainless steel, iron, ductile iron, brass, bronze, stainless steel, plastics, and composite materials and combinations thereof.

The standpipe 195 is coupled to the inlet elbow 300 using bolts 196. A saturation ring 199, a drain ring 198 and an inlet flange seal 197 are captured between the inlet flange on the standpipe 195 and the inlet elbow 300.

Head 100C defines a hollow interior and has a generally rounded outer configuration that includes a number of recessed portions that are configured to protect components mounted thereon. In particular, head 100C includes main cap recess 100C-1, side cap recess 100C-2, and valve access channel 100C-3. Main cap recess 100C-1 surrounds cylinder 112, which has an inner surface and an outer surface. The inner surface of cylinder 112 defines a main outlet port of head 100C and the outer surface is threaded so that a complementarily threaded coupling member of a fire hose can be fastened thereon, as is well known to those skilled in the art.

Side cap recesses 100C-2 surround cylinders 114A and 114B, each of which has an inner surface and an outer surface. The respective inner surfaces define auxiliary side outlet ports of head 100C and the respective outer surfaces are threaded so that either a complementarily threaded coupling member of a fire hose or a threaded side cap (e.g., side cap 108A) can be fastened thereon.

Valve access channel 100C-3 is formed in the upper portion of head 100C and is configured to receive tongue 106A that extends from cap body 106C of locking cap 106. The tongue 106A prevents access to valve control device 200 (described in more detail below with reference to FIG. 2) disposed within fire hydrant body 100 when the locking cap 106 is secured to the head 100C. Additional details of the fire hydrant body 100 are explained in more detail in co-owned, co-pending U.S. application Ser. No. 12/482,366, filed on Jun. 10, 2009 and entitled "Locking Fire Hydrant" the disclosure of which is incorporated herein by reference in its entirety for all purposes. Additional details regarding a fire hydrant body that is configured to protect a locking cap from being tampered with by unauthorized users are set forth in U.S. Pat. No. 6,688,326 B1, the disclosure of which is incorporated herein by reference in its entirety for all purposes.

The locking mechanism 124 is surrounded by an optional lock cover 122, which has a generally cylindrical configuration. Lock cover 122 is provided to minimize the degree to which the locking mechanism is exposed to potentially harmful elements, e.g., dirt, foreign objects, etc. Lock cover 122 can be made from any suitable material. By way of example, lock cover 122 can be made of stainless steel or plastic. Gasket 126 is provided on the inner surface of locking cap 106 to provide a seal around the main outlet port when the locking cap is mounted on fire hydrant body 100.

The locking mechanism 124 includes top plate 128, which has a central hole and three peripheral holes formed therethrough. The outer surface of top plate 128 is configured to receive spring support 130, and the inner surface of the top plate is provided with three mounting anchors. Three pairs of support arms 132 connect top plate 128 to the inner surface of locking cap 106. Each support arm 132 has three holes formed therethrough. One end of each support arm 132 is fastened to one of the mounting anchors on the inner surface of top plate, and the opposite end of each support arm is fastened to one of mounting anchors 106C provided on the inner surface of locking cap 106. Support arms 132 are fastened using bolts 134 and hex nuts 136; however, it will be apparent to those skilled in the art that other suitable fasteners can be used. A cam gear 138 is rotatably fastened between each pair of support arms 132. Each cam gear 138 has a cam surface at one end thereof and a set of gear teeth at the opposite end thereof.

Three springs 140 are disposed between top plate 128 and cap plate 142, which has a central hole formed therethrough. In one embodiment, springs 140 are heavy duty die springs (at least about 2,500 pounds total spring pressure); however, it will be apparent to those skilled in the art that any suitable springs can be used. Each spring 140 is disposed on a spring shaft 144, which has a hollow interior that receives a screw 146. Each screw 146 is threaded into spring support 130. Washers 148 are disposed between the head of each screw 146 and the outer surface of cap plate 142.

Actuator pin 150 extends through a central aperture defined in locking cap 106. Rack 152 has a generally cylindrical configuration and a hollow interior and receives extension portion of actuator pin 150. The outer surface of rack 152 is provided with a number of cylindrical gears, which are configured to mate with the gear teeth provided at one end of each of cam gears 138.

To enable locking mechanism 124 to operate when lock cover 122 is in place, slots are provided in the locking cover. Each slot is located so that the cam surface of a cam gear 138 can extend therethrough and interface with a mating surface inside the fire hydrant body to lock and unlock locking mechanism 124.

Figure 2:
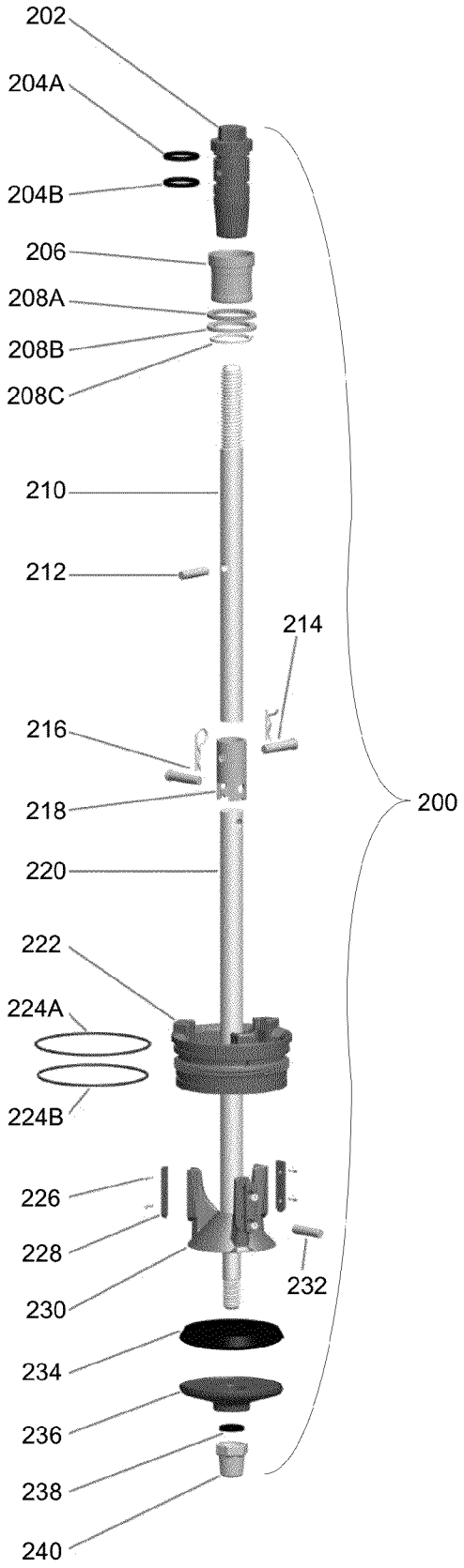
FIG. 2 is an exploded view of the components of a valve control device 200, in accordance with embodiments of the invention.

FIG. 2 is an exploded view of the components of a valve control device 200, in accordance with embodiments of the invention. The valve control device 200 includes an operating nut 202, seals 204A, 204B, operating nut sleeve 206, thrust washers 208A, 208B, and retaining ring 208C. The seals 204A, 204B provide a substantially water tight seal between the operating nut 202 and the valve access channel 100C-3 in the head 100C (see FIG. 1). The operating nut 202 is attached to an upper operating stem 210. One or more stem grooved pins 212 are included in the upper operating stem 210. The upper operating stem 210 is coupled to a lower operating stem 220 by a safety coupling 218 and coupling pins and keys 214, 216. The lower operating stem 220 passes through a valve seat ring 222.

Additional details of the fire hydrant 100 are described in co-pending, co-owned U.S. application Ser. No. 12/787,328, entitled "Fire Hydrant Control Valve" and filed on May 25, 2010, which is incorporated by reference herein, in its entirety for all purposes.

Sprinkler Cap

FIGS. 3A-3F illustrate a sprinkler cap 106' in accordance with embodiments of the present invention. The sprinkler cap 106' can be used as an alternative to the locking cap 106 in the fire hydrant 100 as described above. The sprinkler cap 106' provides the additional features of sprinkler ports 302 and a sprinkler cap control lock 310. It should be understood that the sprinkler ports 302 could be alternatively and/or additionally included in the one or more of the side caps 108A, 108B.

The sprinkler cap 106' includes a tongue 106A' that includes a hole 312 (see FIG. 3E) where the sprinkler cap control lock 310 is secured. The sprinkler control lock 310 includes a locking mechanism 330. A key 332 is used to unlock the locking mechanism 330. The locking mechanism 330 is secured to the sprinkler control lock 310 by a nut 334. A double-sided cam 320 is secured to the locking mechanism 330 by nut 336. The locking mechanism 330 rotates the double-sided cam 320 between a locked orientation and an unlocked orientation. It should be understood that any suitable locking mechanism can be used instead of locking mechanism 330 shown herein.

Figure 3A:
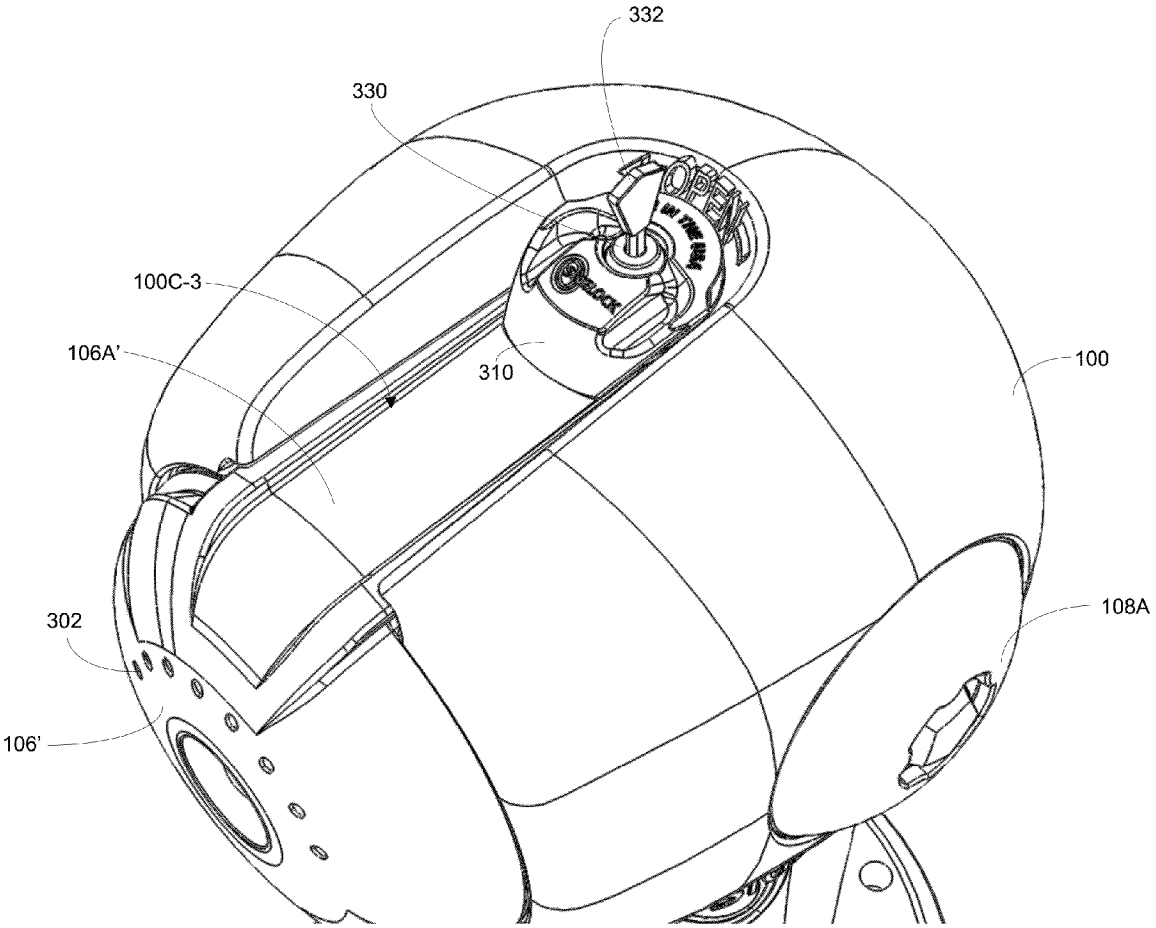
FIGS. 3A-3F illustrate a sprinkler cap in accordance with embodiments of the present invention.
Figure 3B:
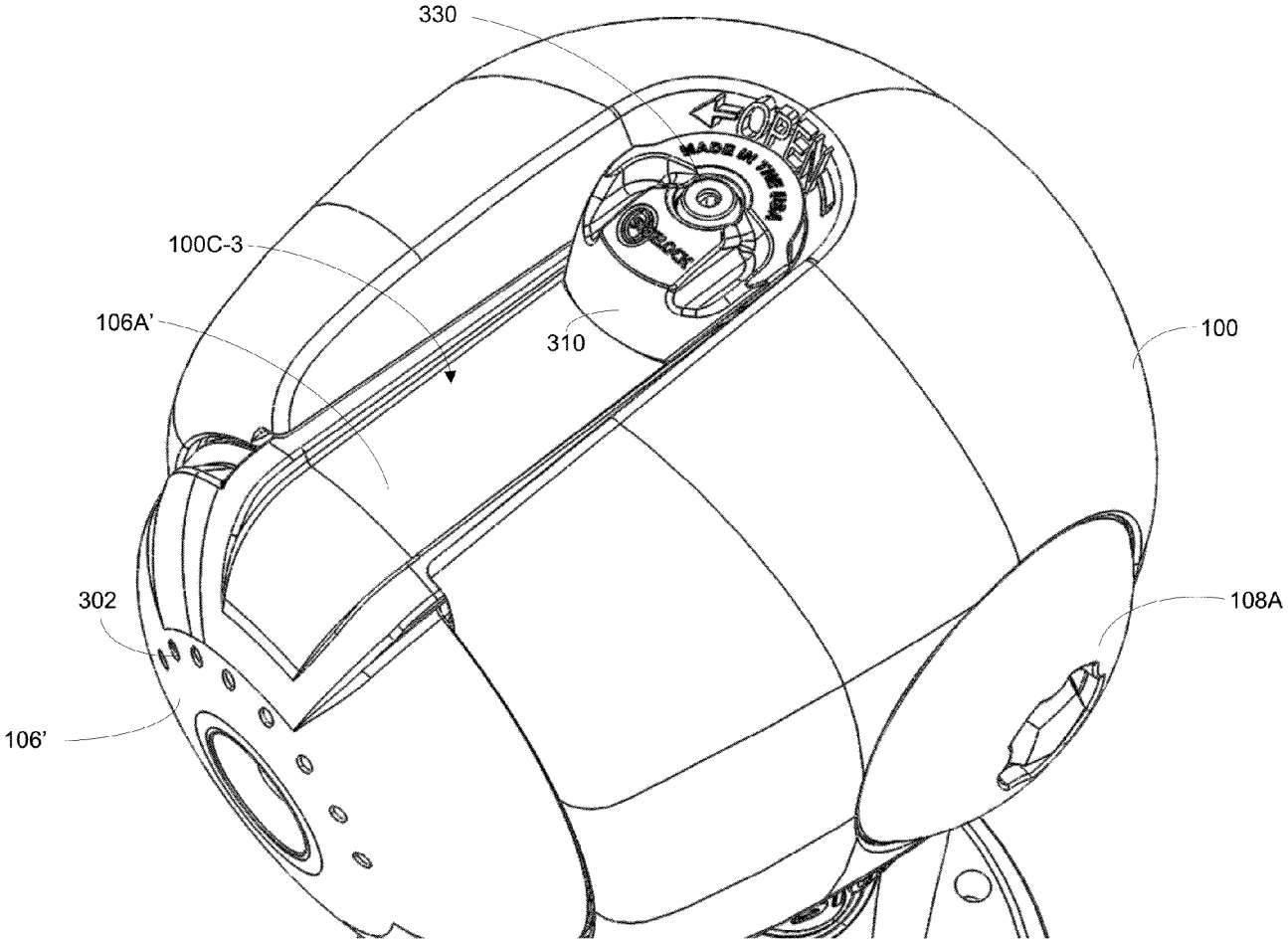
Figure 3C:
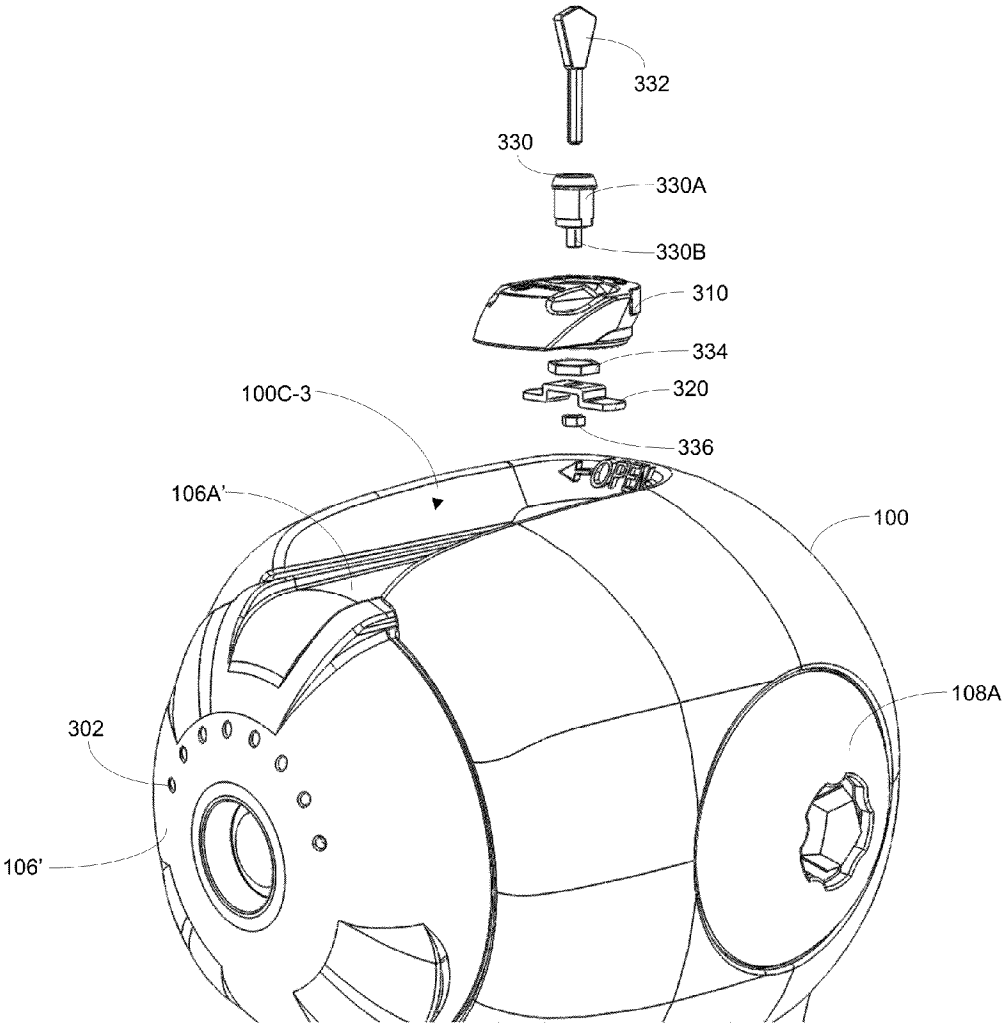
Figure 3D:
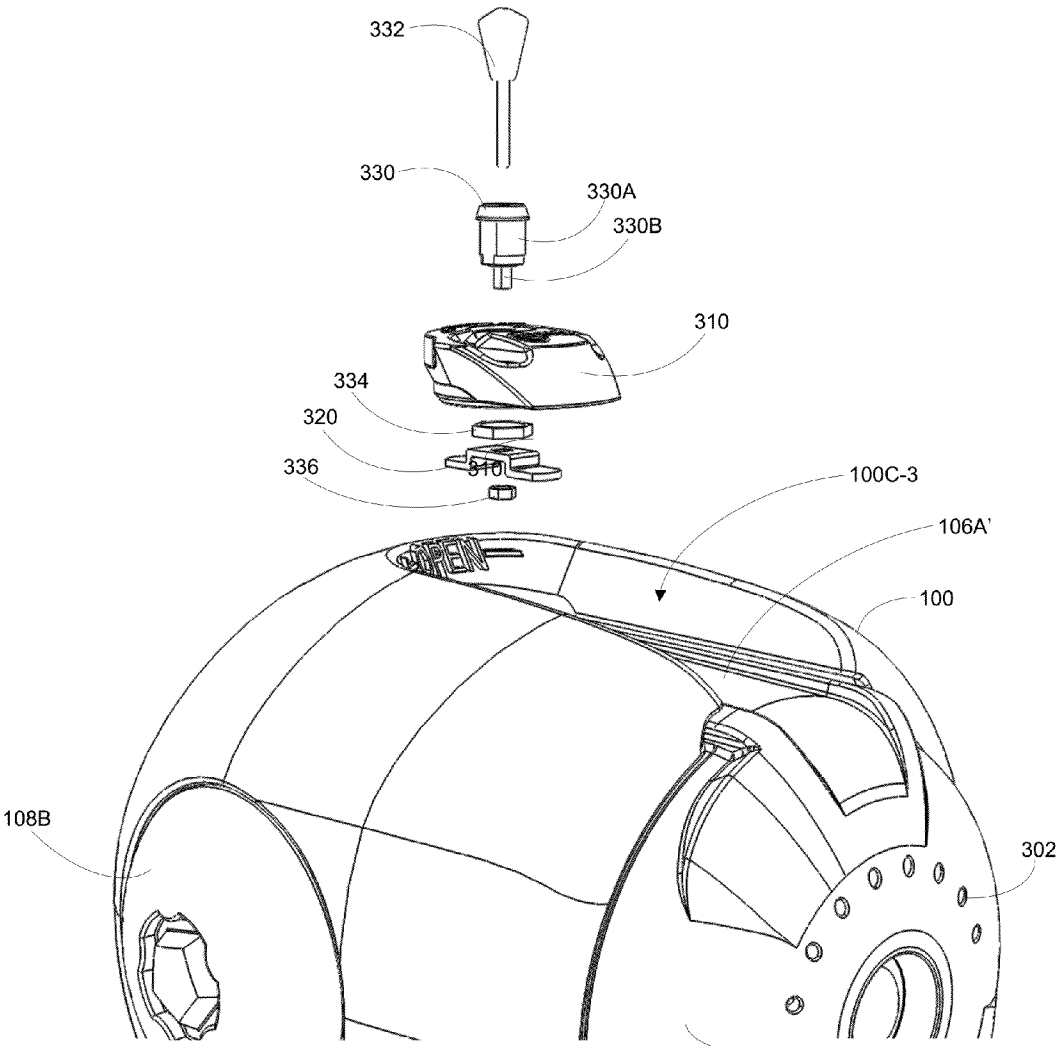
Figure 3E:
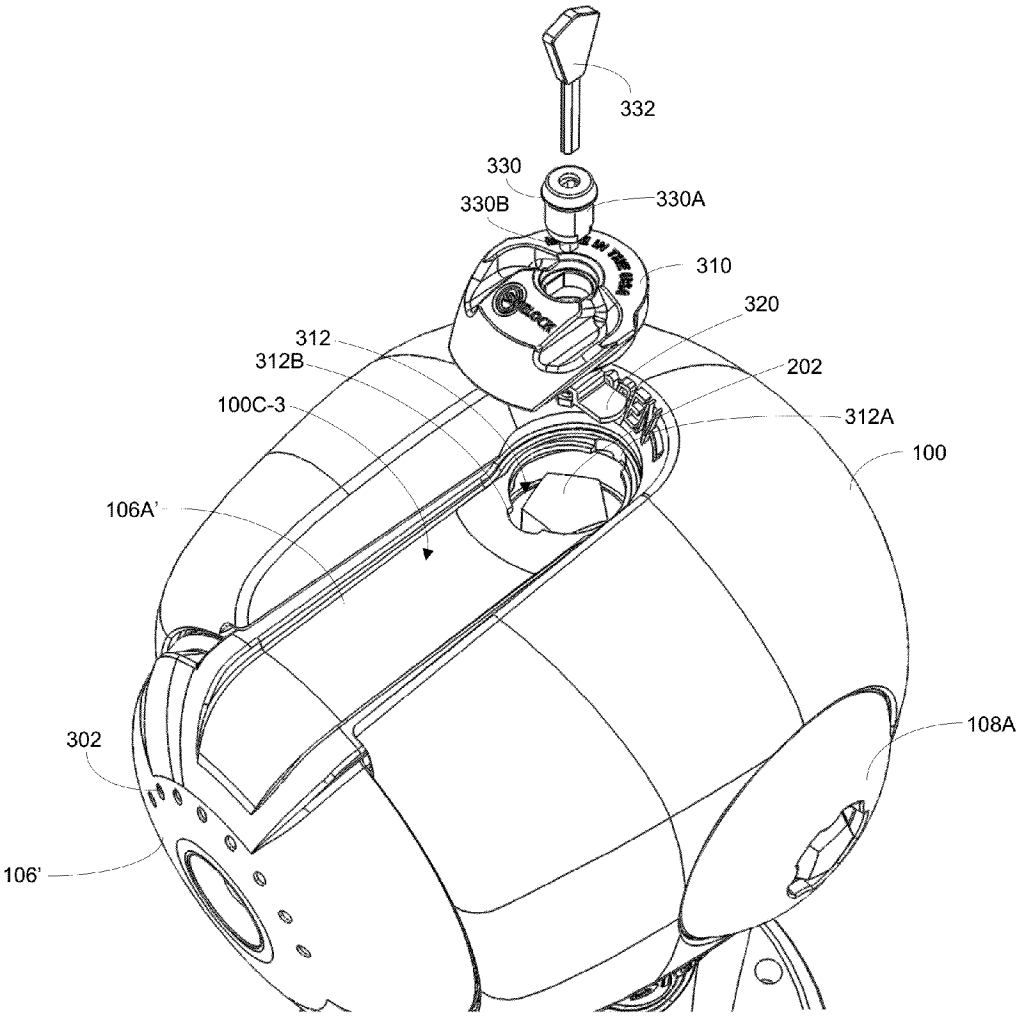
Figure 3F:
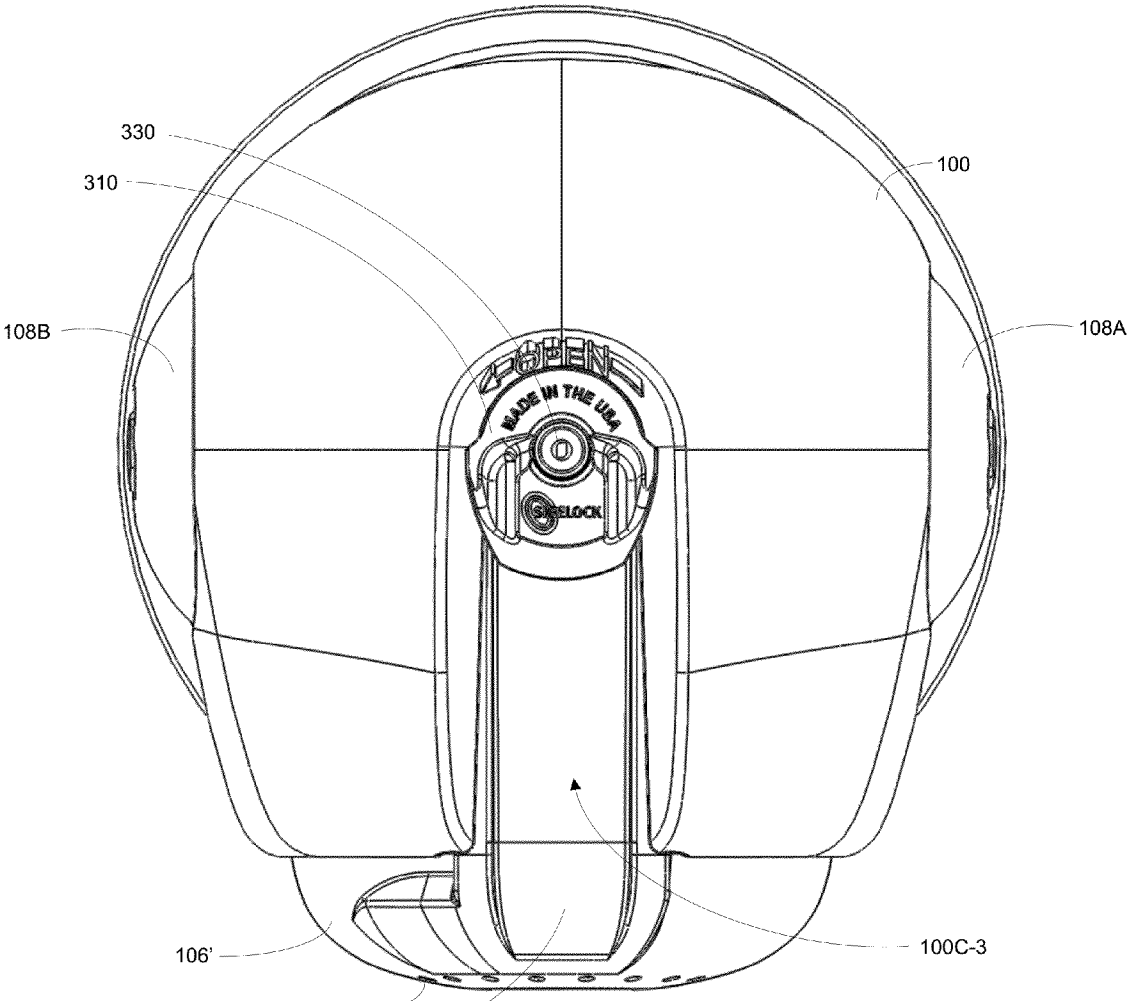

Referring now to FIG. 3E, the double-sided cam 320 is rotated to align with slots 312A and 312B in the unlocked orientation. In the locked orientation, the double-sided cam 320 is rotated so as to not align with slots 312A and 312B. In the unlocked orientation, the sprinkler cap control lock 310 can be removed from the tongue 106A'.

Removing the sprinkler cap control lock 310 from the tongue 106A' uncovers the operating nut 202. Once the operating nut 202 is uncovered, an operating tool can be used to turn the operating nut and thereby deliver water through the sprinkler ports 302 of sprinkler cap 106'.

In this way an authorized person can use the key 332 to remove the sprinkler cap control lock 310 and activate the operating nut 202. If desired, after operating nut 202 has been activated, the sprinkler cap control lock 310 can be secured to tongue 106A' so that the operating nut cannot be tampered with while the sprinkler cap 106' is in operation. At some later time, the authorized person can again remove the sprinkler cap control lock 310, deactivate the operating nut 202, and then secure the sprinkler cap control lock to tongue 106A' once again so that the operating nut is protected from tampering.

FIGS. 4A, 4B, and 6A-6E show additional details of the sprinkler cap control lock 310, in accordance with embodiments of the present invention. The sprinkler cap control lock 310 includes hand holds 402 for gripping and lifting the sprinkler cap control lock. The channels defining hand holds 402 also serve to allow water to drain from sprinkler cap control lock 310.

The sprinkler cap control lock 310 sides 301A, 310B are substantially parallel and close-fitting to the respective sides 100C-3A, 100C-3B of the channel 100C-3. Having the sprinkler cap control lock 310 sides 301A, 310B substantially parallel and close-fitting to the respective sides 100C-3A, 100C-3B of the channel 100C-3 prevents tampering by not providing any substantial surface or edge into which a tool such as a prying tool or a wedging tool can be forced. This substantially prevents an unauthorized person from tampering with the sprinkler cap control lock 310.

The sprinkler cap control lock 310 includes a lock mechanism channel 602 for receiving the locking mechanism 330. The sprinkler cap control lock 310 is formed from a durable material similar to the materials used in the fire hydrant 100. Using a similar durable material reduces the opportunity for tampering with the sprinkler cap control lock 310. Using similar materials also reduces the opportunity for electrolytic corrosion due to dissimilar materials being in close contact. In one embodiment, the sprinkler cap control lock 310 is a solid construction, e.g., a solid casting. Alternatively, the sprinkler cap control lock 310 can be machined from a solid blank.

Figure 4A:
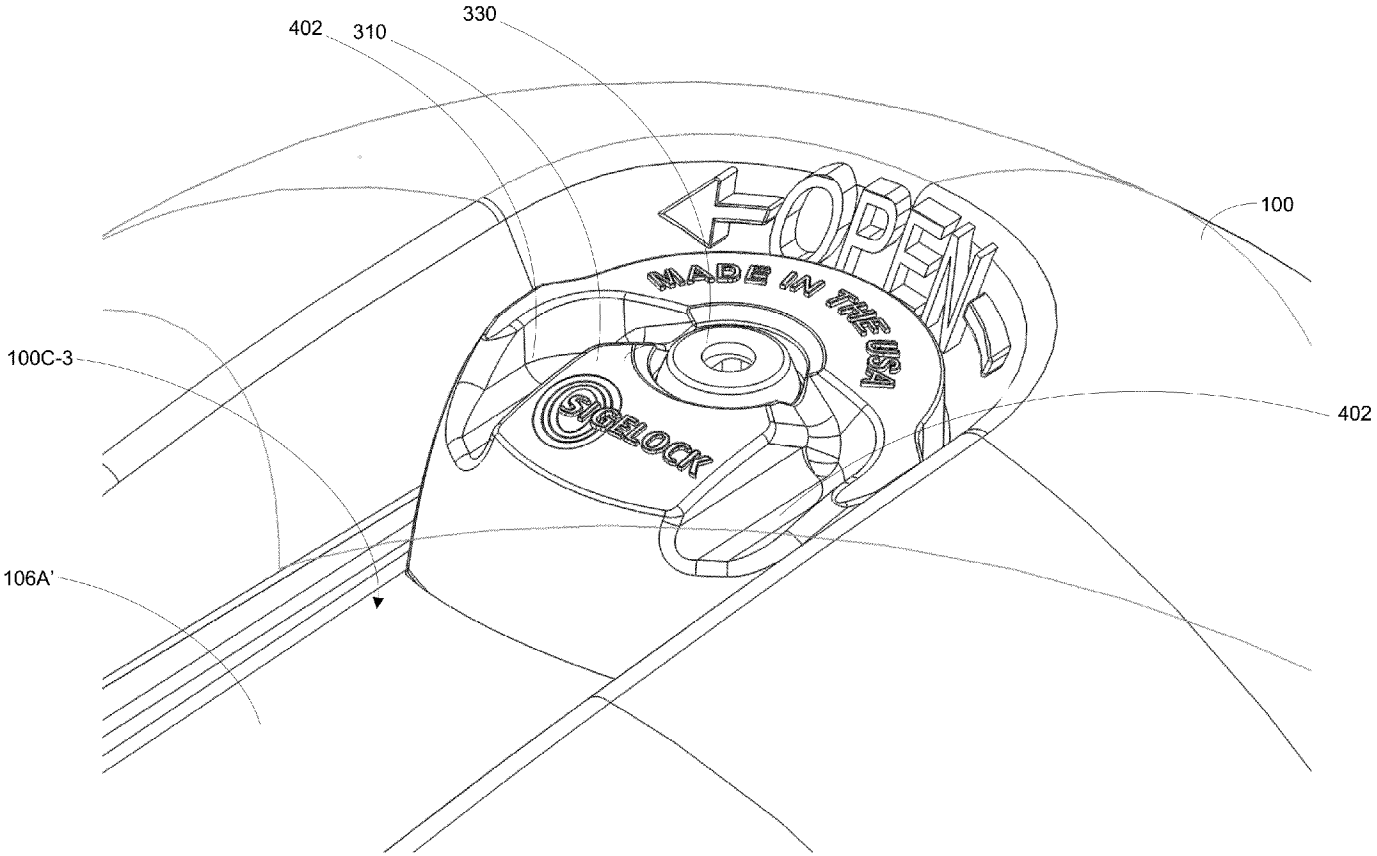
FIGS. 4A and 4B show additional details of the sprinkler cap control lock, in accordance with embodiments of the present invention.
Figure 4B:
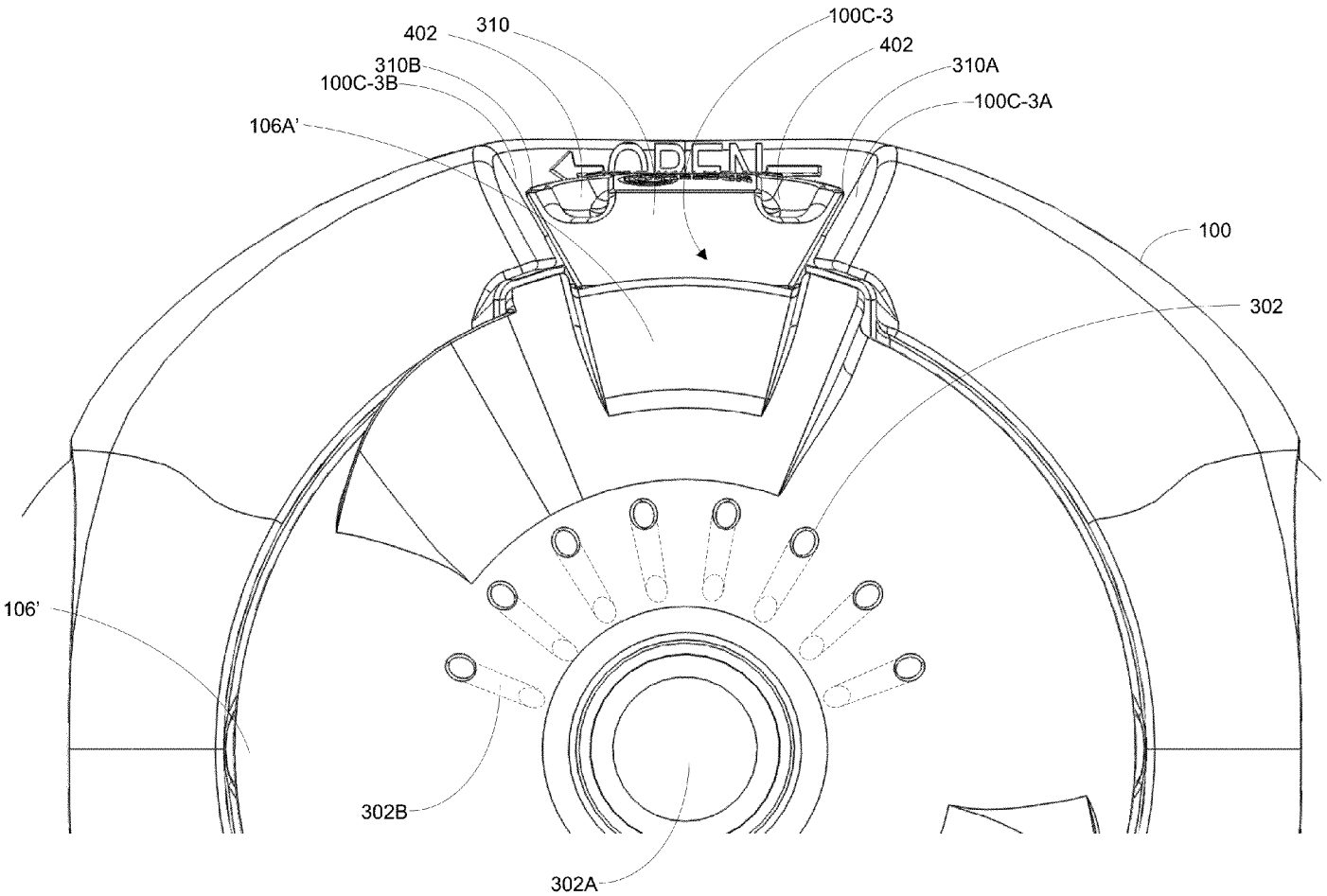

Referring again to FIG. 4B, the sprinkler cap 106' can include multiple sprinkler ports 302. The number of sprinkler ports 302 can be varied to meet the needs of particular situations. By way of example, sprinkler cap 106' can have as few as one or two sprinkler ports 302 or as many as 10 or 20 sprinkler ports. The sprinkler ports 302 can be arranged in any desired fashion on the face or edges of the sprinkler cap 106'. In one exemplary orientation shown in FIG. 4B, the sprinkler ports 302 are arranged in a radial fashion which radiates outward from an approximate center 302A as shown in FIG. 4B. It should be understood that other arrangements including, for example, multiple rows of ports, ports located at different angles, and ports having different spacing also could be used.

Figure 5A:
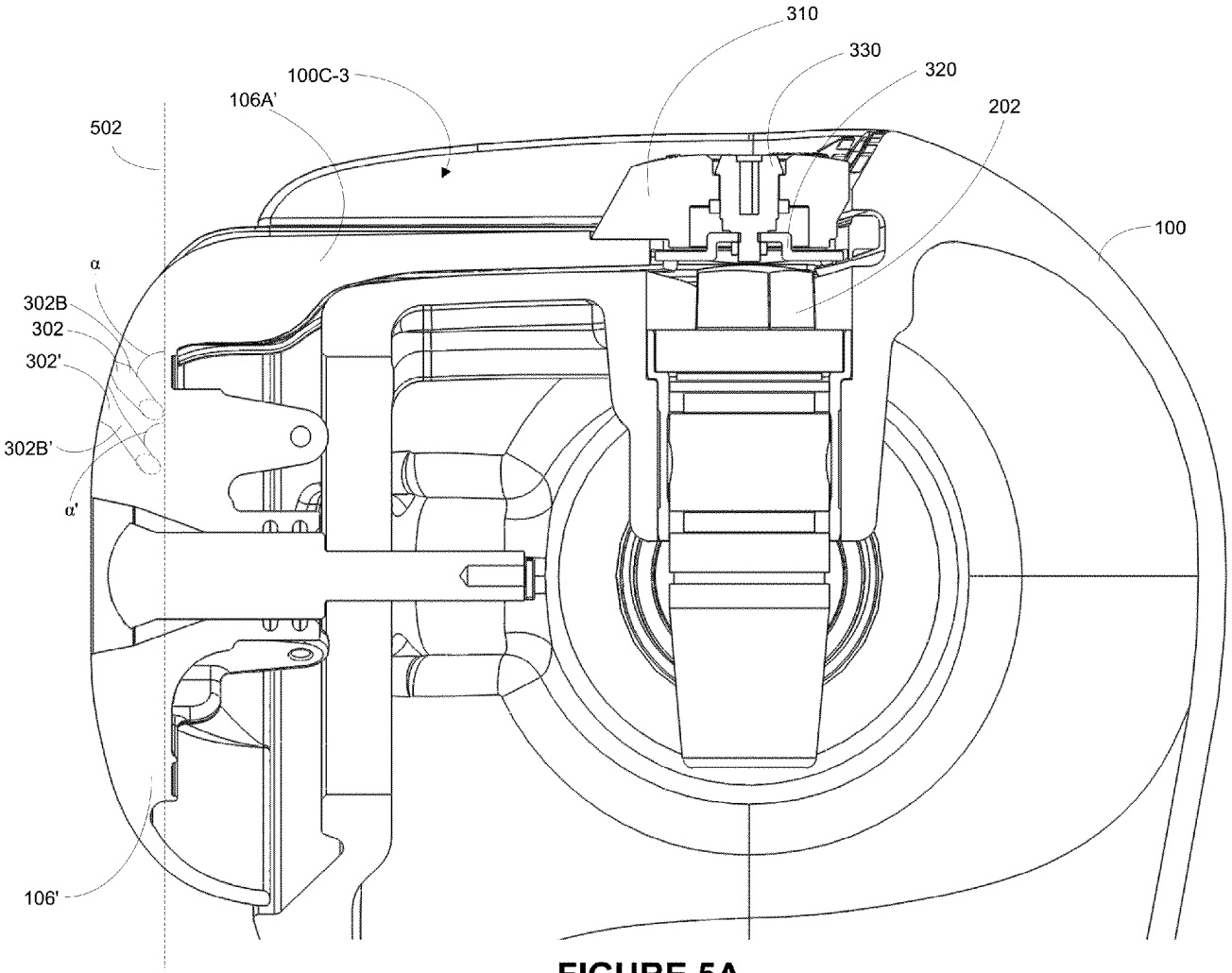
FIGS. 5A and 5B show a sectional view of the sprinkler cap, in accordance with embodiments of the present invention.
Figure 5B:
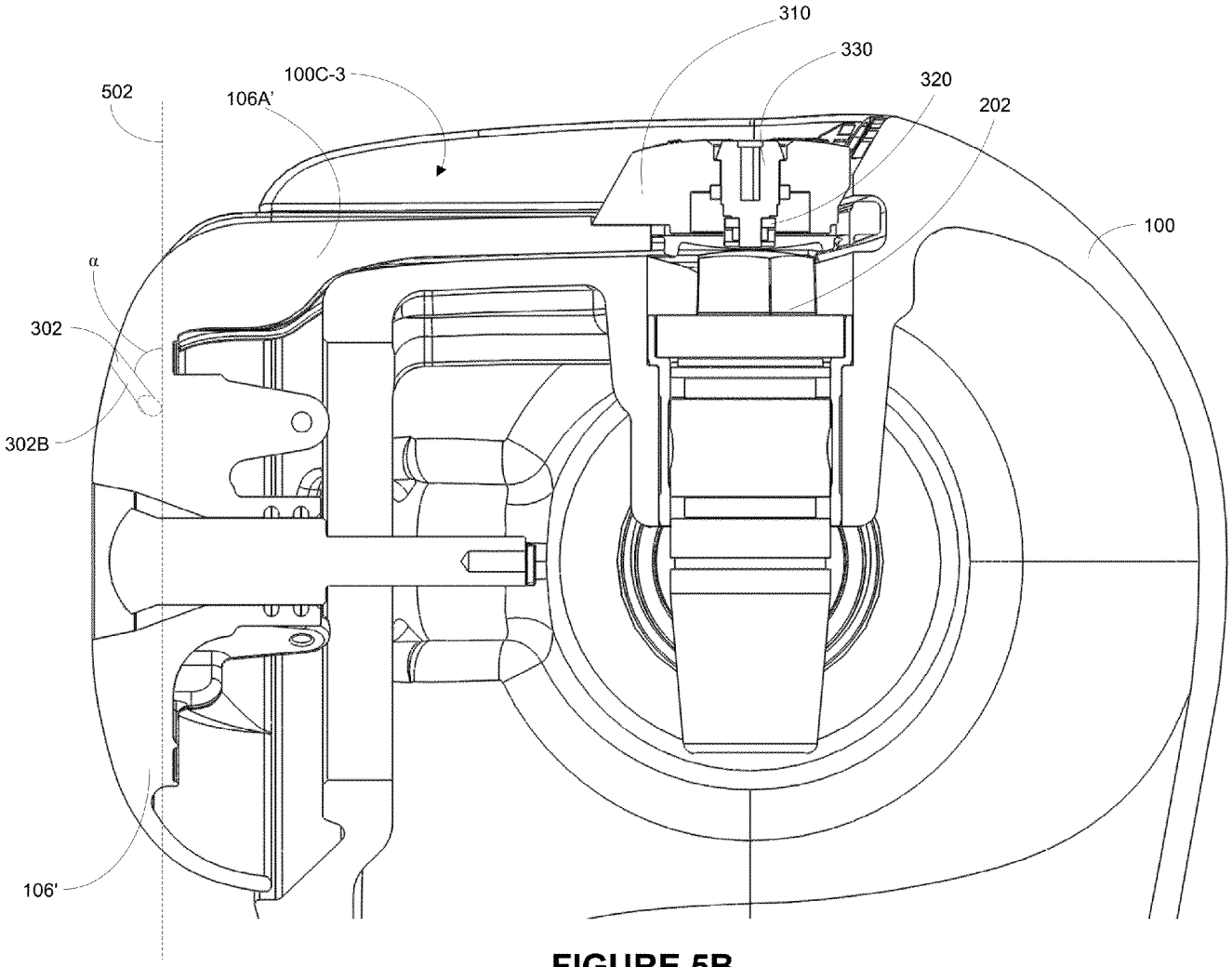
Figure 6A:
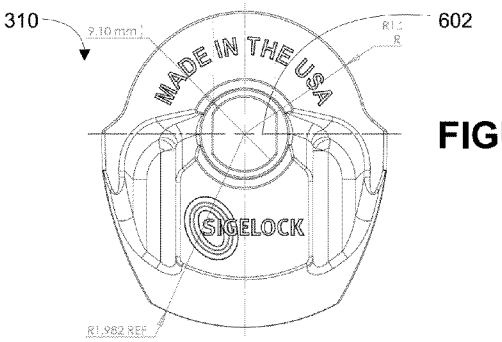
FIGS. 6A-6E show additional details of the sprinkler cap control lock, in accordance with embodiments of the present invention.
Figure 6E:
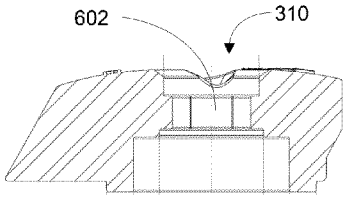
Figure 6B:
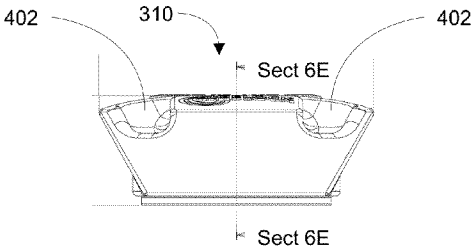
Figure 6C:
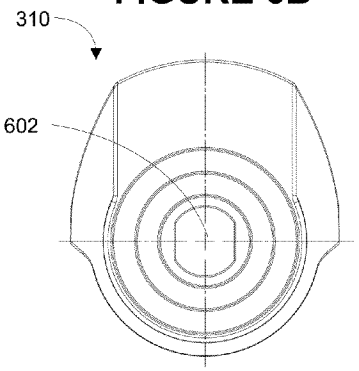
Figure 6D:
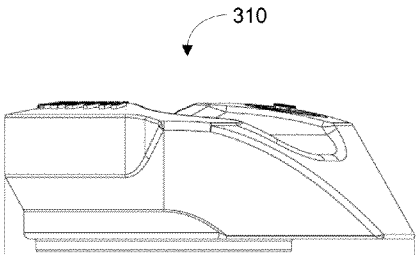
Figure 6F:
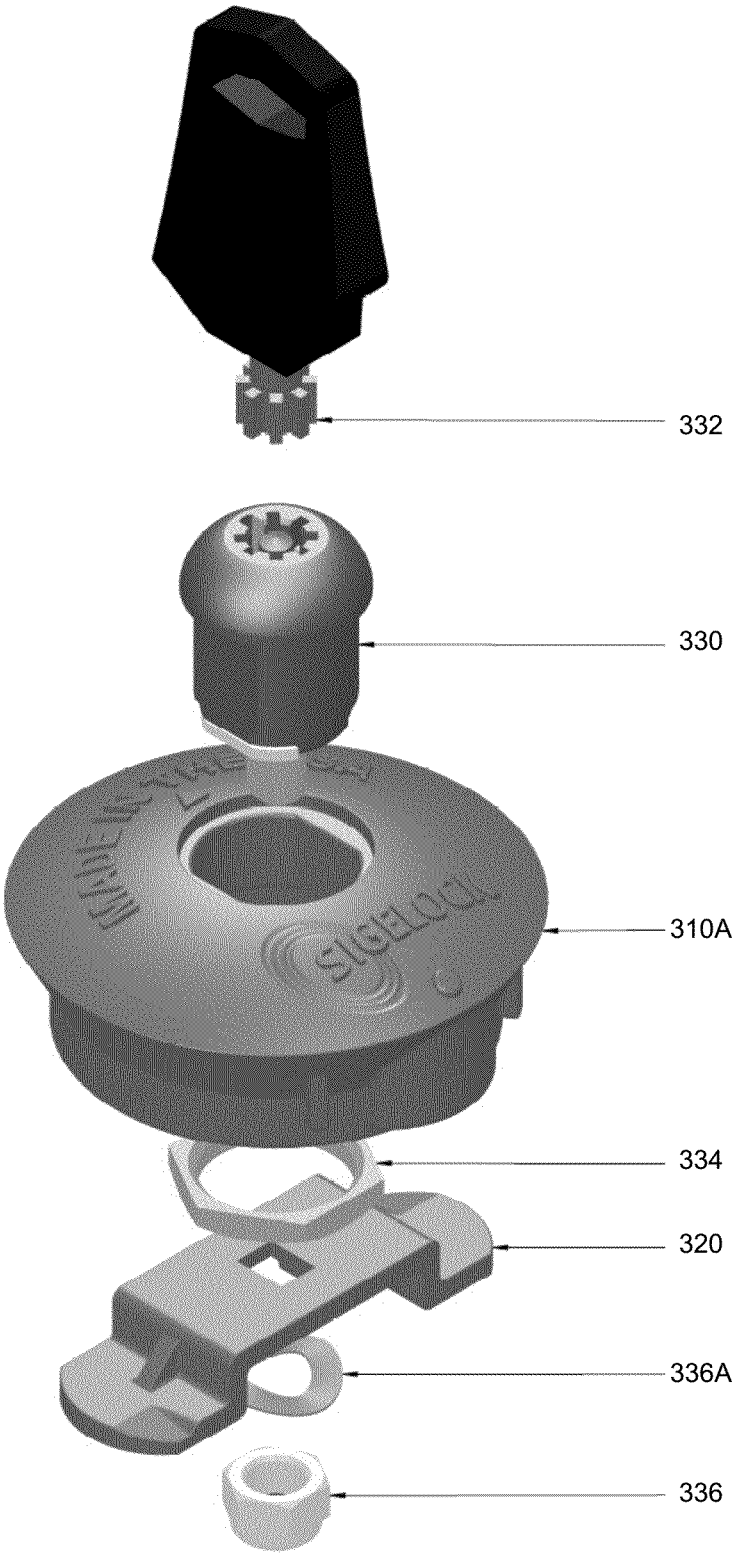
FIGS. 6F-6K show an alternative sprinkler cap control lock, in accordance with embodiments of the present invention.
Figure 6I:
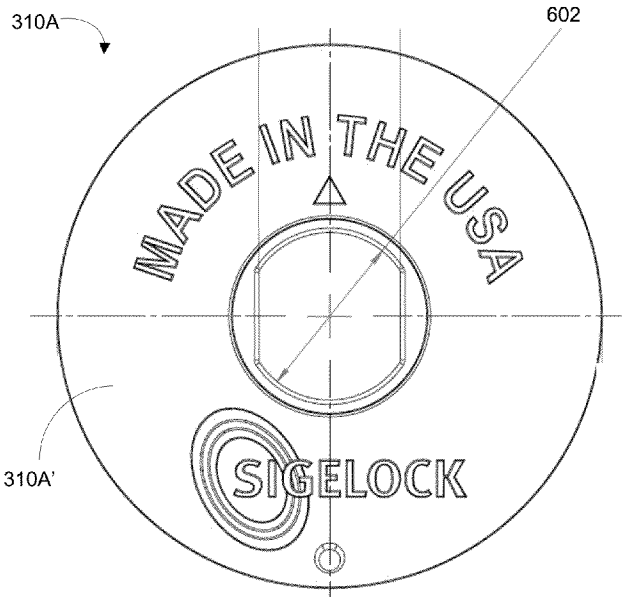
Figure 6J:
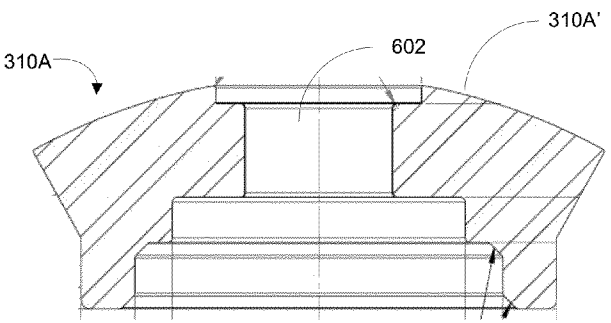
Figure 6H:
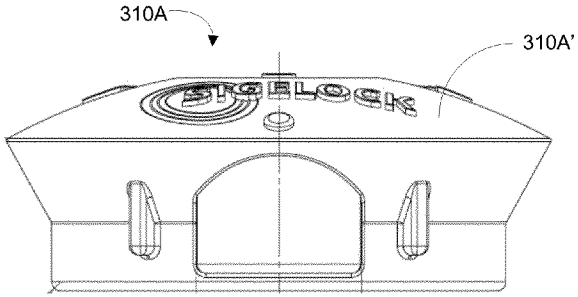
Figure 6G:
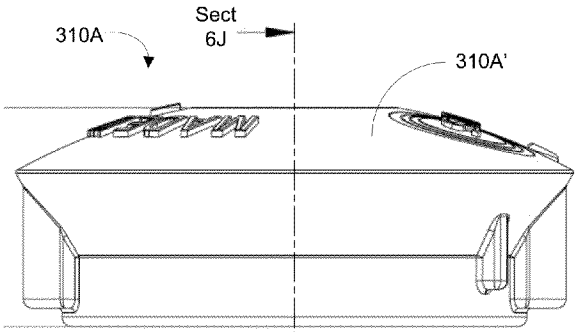
Figure 6K:
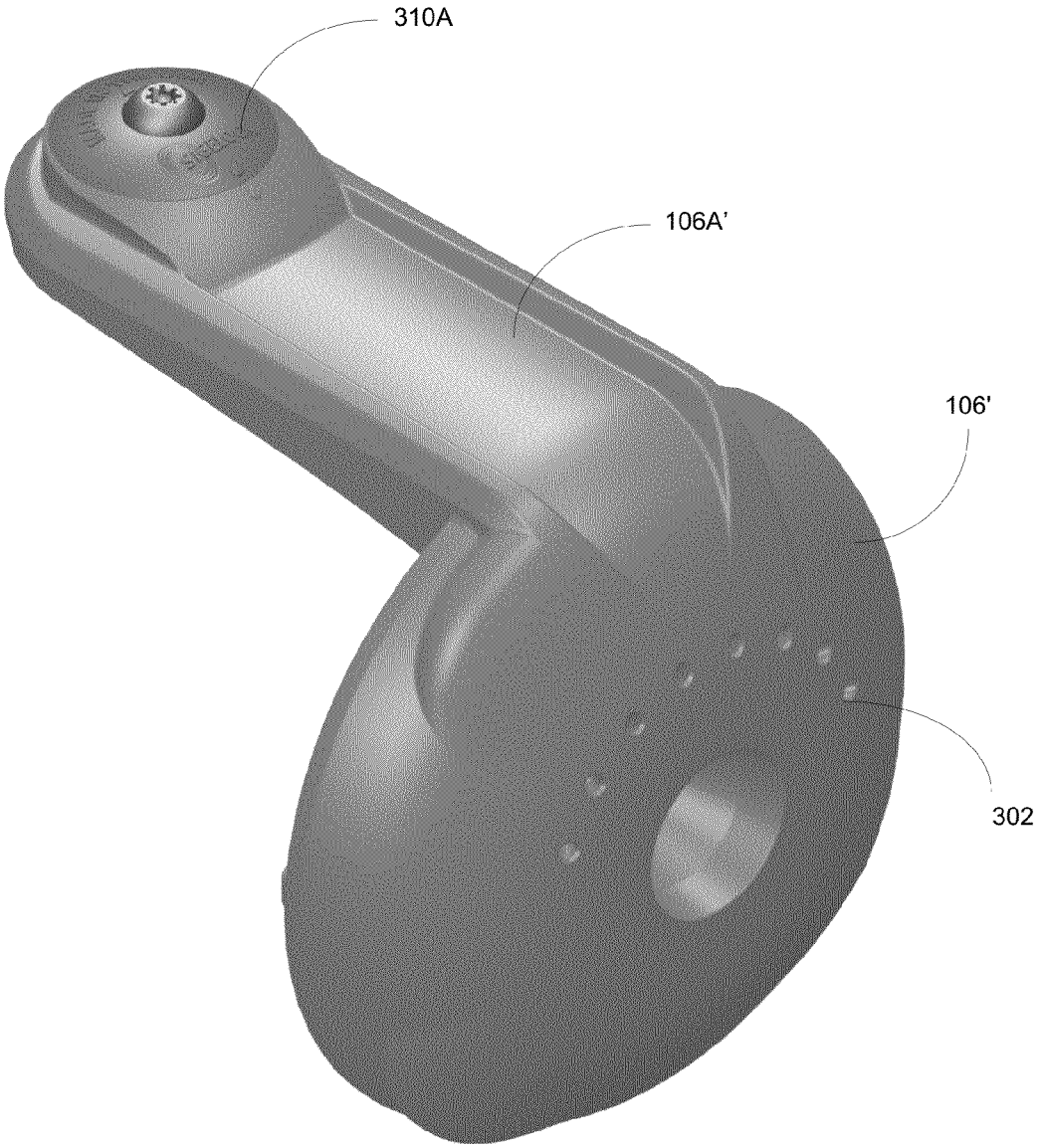
Figure 7B:
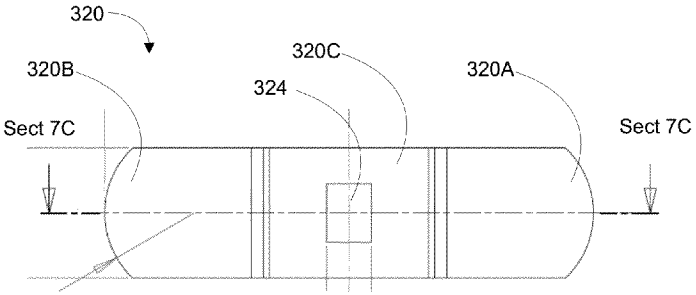
FIGS. 7A-7D are detailed views of the double-sided cam, in accordance with embodiments of the present invention.
Figure 7C:
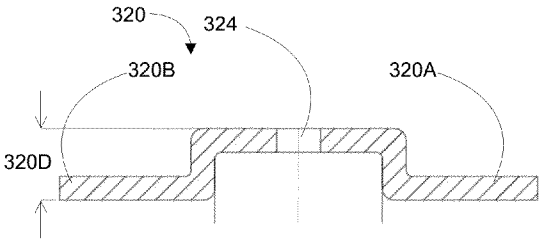
Figure 7D:
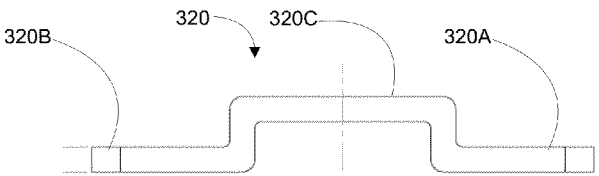
Figure 7A:
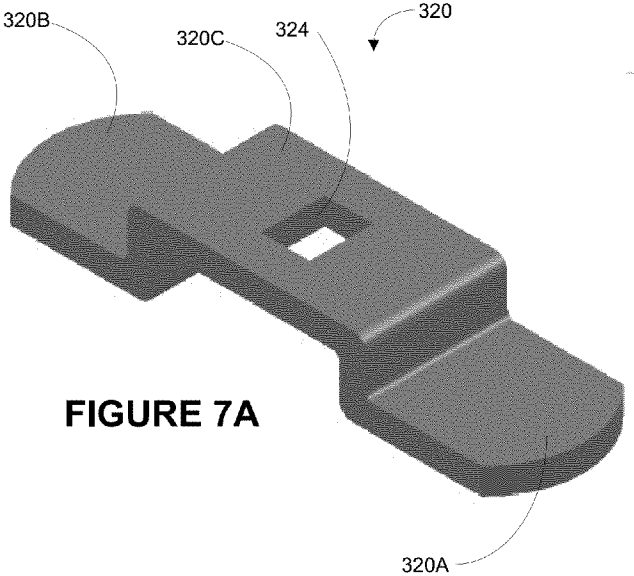

FIGS. 5A and 5B show a sectional view of the sprinkler cap 106', in accordance with embodiments of the present invention. FIG. 5A shows the double-sided cam 320 in the unlocked orientation. In FIG. 5B, only a small portion of the double-sided cam 320 is visible because the double-sided cam is in the locked orientation.

FIGS. 6F-6K show an alternative sprinkler cap control lock 310A, in accordance with embodiments of the present invention. The alternative sprinkler cap control lock 310A includes a top surface 310A' that has a substantially rounded profile. The rounded top surface 310A' is substantially flush with the top surface of the tongue 106A'. Having the sprinkler cap control lock 310A substantially flush with the top surface of the tongue 106A' prevents tampering by not providing any substantial surface or edge into which a tool such as a prying tool or a wedging tool can be forced. This substantially prevents an unauthorized person from tampering with the sprinkler cap control lock 310A.

The sprinkler cap control lock 310A includes a lock mechanism channel 602 for receiving the locking mechanism 330. The sprinkler cap control lock 310A is formed from a durable material similar to the materials used in the fire hydrant 100. Using a similar durable material reduces the opportunity for tampering with the sprinkler cap control lock 310A. Using similar materials also reduces the opportunity for electrolytic corrosion due to dissimilar materials being in close contact. In one embodiment, the sprinkler cap control lock 310A is a solid construction, e.g., a solid casting. Alternatively, the sprinkler cap control lock 310A can be machined from a solid blank.

FIGS. 7A-7D are detailed views of the double-sided cam 320, in accordance with embodiments of the present invention. The double-sided cam 320 includes a central portion 320C and two end portions 320A, 320B. As shown, in one embodiment, the double-sided cam 320 can have an offset between the central portion 320C and the two end portions 320A, 320B. It should be understood, however, that in some situations the offset may not be needed. The central portion 320C includes a keyway 324 that is secured to the locking mechanism 330 so that the locking mechanism can rotate the double-sided cam 320.

An approximate vertical reference line 502 is provided to illustrate the approximate angle $\alpha$ and $\alpha'$ formed between the sprinkler ports 302 and the vertical reference line. The angle $\alpha$ and $\alpha'$ can be between about 30 and about 60 degrees. The angle $\alpha$ can vary from one sprinkler port 302 to another. In one embodiment, the angle $\alpha$ and/or $\alpha'$ is about 45 degrees.

In one embodiment, the sprinkler ports 302 have an inner diameter of between about 0.125 inch and about 0.375 inch. It is to be understood, however, that the use of larger and smaller diameters could be appropriate in certain instances. By way of example, a sprinkler port 302, 302' could have a built-in diffuser nozzle. Alternatively, sprinkler ports 302, 302' could have respective inner or outer tapers to act as a nozzle or diffuser as may be desired.

Figure 8:
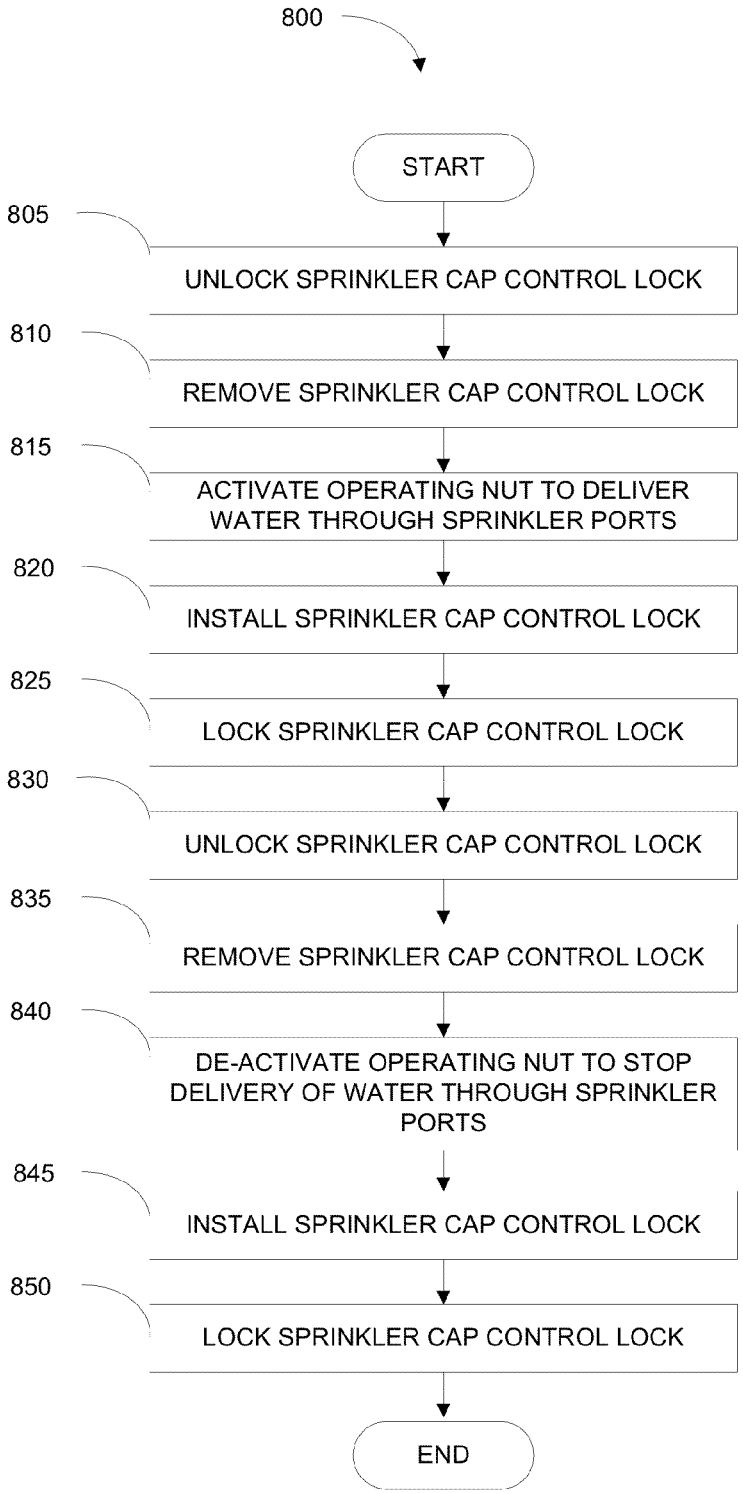
FIG. 8 is a flowchart diagram that illustrates the method operations performed in activating and deactivating the sprinkler cap, in accordance with embodiments of the present invention.

FIG. 8 is a flowchart diagram that illustrates the method operations performed in activating and deactivating the sprinkler cap, in accordance with embodiments of the present invention. The operations illustrated herein are by way of example, as it should be understood that some operations may have sub-operations and in other instances, certain operations described herein may not be included in the illustrated operations. With this in mind, the method and operations 800 will now be described.

In an operation 805, the sprinkler cap control lock 310 is unlocked. In an operation 810, the sprinkler cap control lock 310 is removed from the tongue 106A' to provide access to the operating nut 202.

In an operation 815, the operating nut 202 is activated to deliver water through the sprinkler ports 302. In optional operations 820 and 825, the sprinkler cap control lock 310 is reinstalled and secured the tongue 106A'. This prevents unauthorized access to the operating nut 202 while the sprinkler cap 106' is delivering water through the sprinkler ports 302.

If the sprinkler cap control lock 310 was reinstalled after the operating nut was activated, then in an operation 835, the sprinkler cap control lock 310 is unlocked and in an operation 810, the sprinkler cap control lock 310 is removed from the tongue 106A' to again provide access to the operating nut 202.

In an operation 840, the operating nut 202 is de-activated to stop delivery of water through the sprinkler ports 302. In operations 845 and 850, the sprinkler cap control lock 310 is reinstalled and secured to the tongue 106A'. This prevents unauthorized access to the operating nut 202. In the method operations can end.

Lubrication Access

Figure 9A:
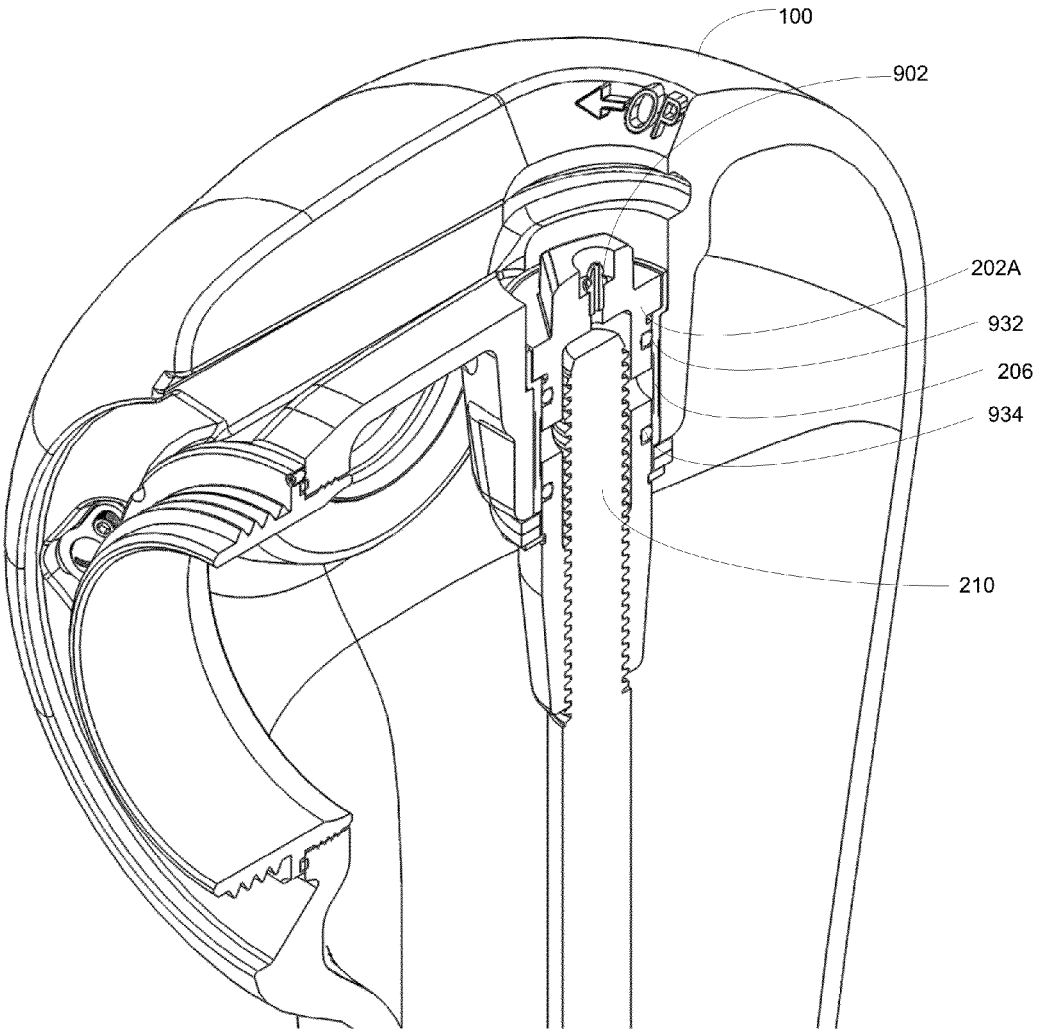
FIGS. 9A and 9B are simplified sectional view schematic diagrams of the fire hydrant in accordance with embodiments of the present invention.
Figure 9B:
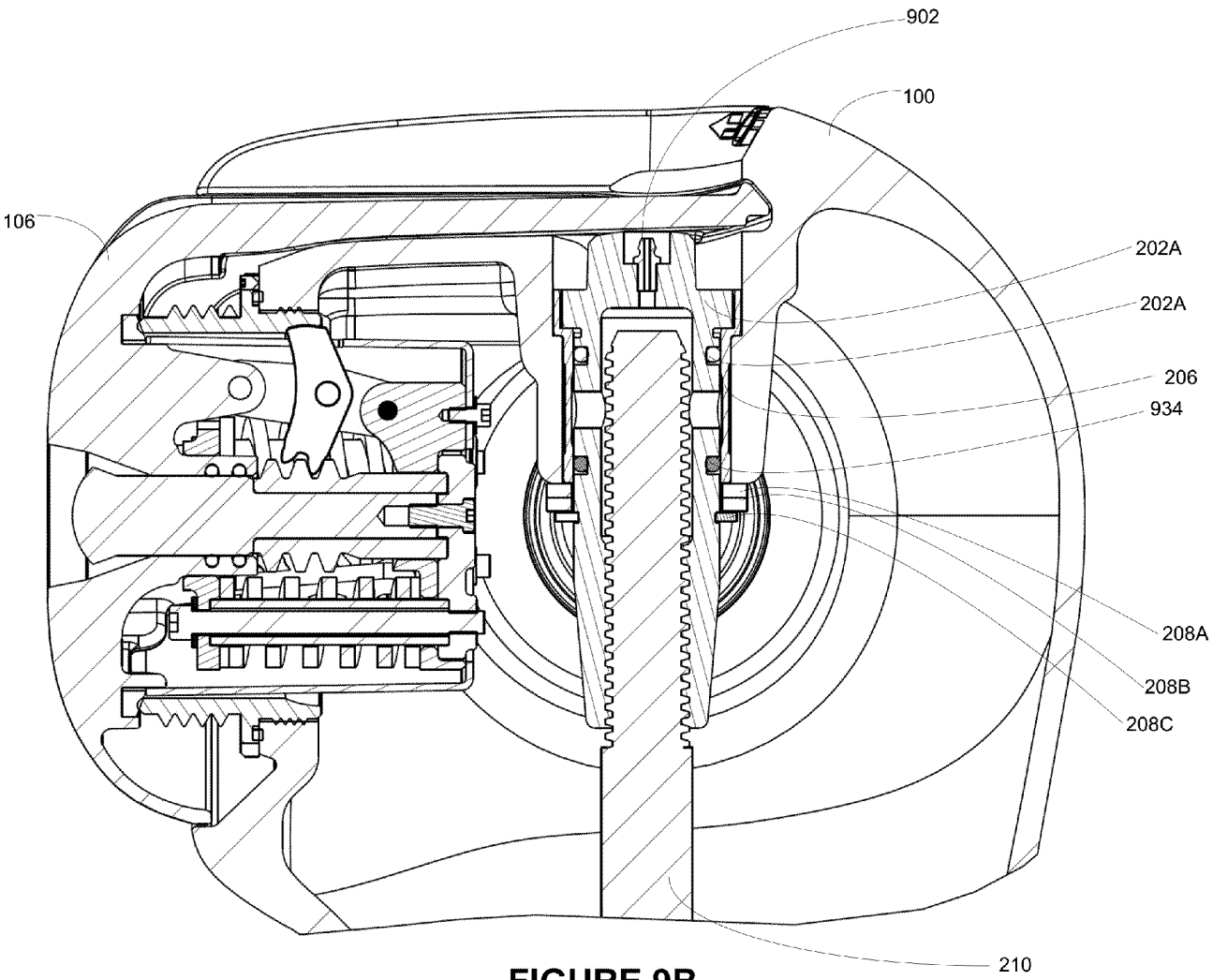
Figures 9C, 9D, 9E, 9F:
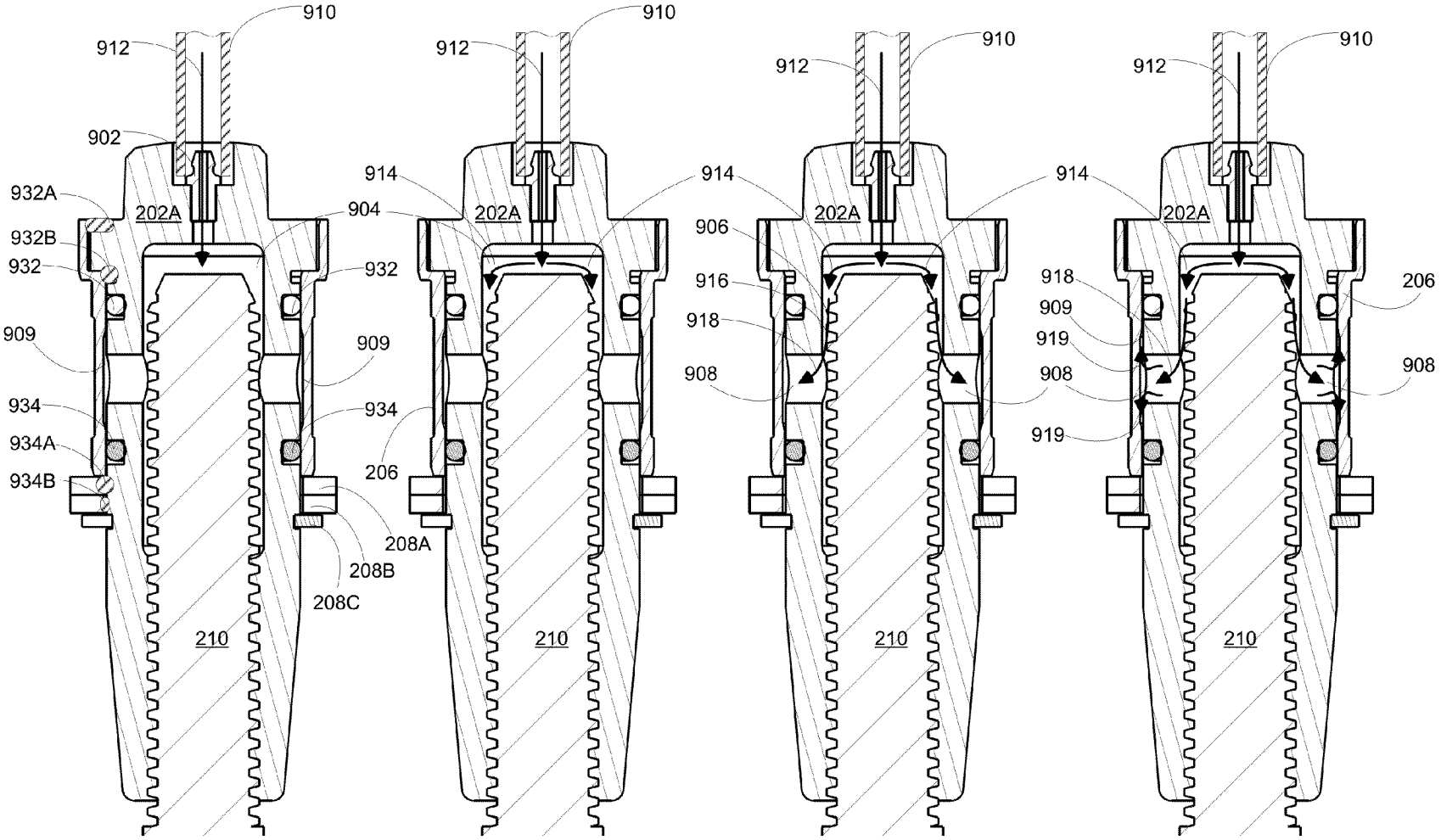
FIGS. 9C through 9F are detailed cross-sectional views of the operating nut, in accordance with embodiments of the present invention.

FIGS. 9A and 9B are simplified sectional view schematic diagrams of the fire hydrant 100 in accordance with embodiments of the present invention. The operating nut 202A includes a lubricant port 902. The operating nut 202A is mechanically coupled to the operating stem 210. As shown the mechanical coupling is threads but it should be understood that the operating nut can be coupled to the operating stem with pins or other to the types of fasteners.

Figure 10:
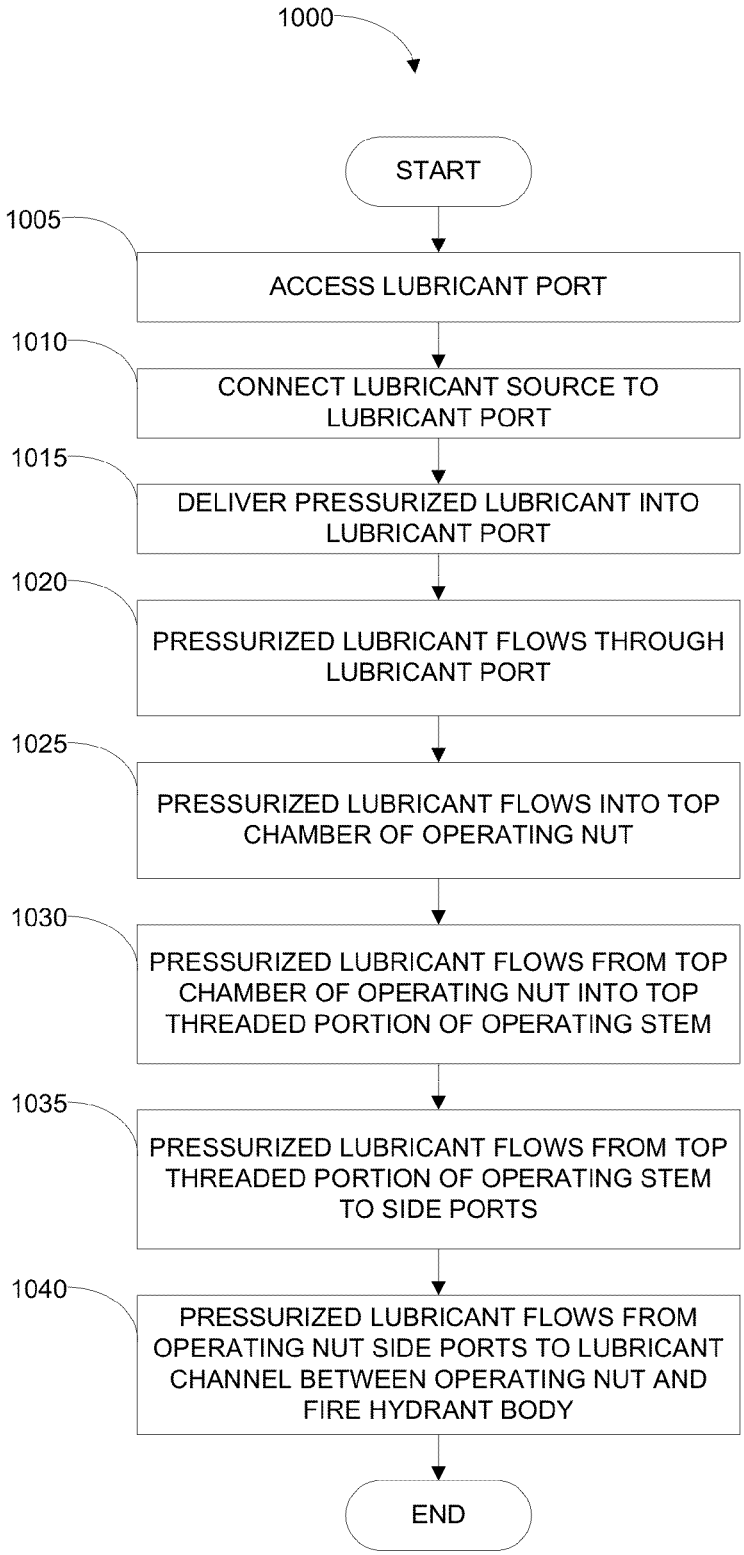
FIG. 10 is a flowchart diagram that illustrates the method operations performed in the progression of the lubricant through the operating nut, in accordance with embodiments of the present invention.

FIGS. 9C through 9F are detailed cross-sectional views of the operating nut 202A, in accordance with embodiments of the present invention. FIGS. 9C through 9F show a progression of the lubricant through the operating nut 202A. FIG. 10 is a flowchart diagram that illustrates the method operations 100 performed in the progression of the lubricant through the operating nut 202A, in accordance with embodiments of the present invention. The operations illustrated herein are by way of example, as it should be understood that some operations may have sub-operations and in other instances, certain operations described herein may not be included in the illustrated operations. With this in mind, the method and operations 1000 will now be described.

In operation 1005, the lubricant port 902 is accessed. This may require removing one or more access points for the locking cap 106 as described elsewhere within the application. By way of example, the locking cap 106 can be removed to access the lubricant port 902 in the operating nut. 202A. In another example, the sprinkler cap control lock 310, 310A, if present, can be removed to access the lubricant port 902 in the operating nut. 202A.

In operation 1010, the lubricant source 910 is connected to lubricant port 902. Important to note that while the lubricant port 902 is shown as a substantially what standard grease fitting this is merely an exemplary embodiment and any suitable type of lubricant port could be utilized. The lubricant port 902 can also include a check valve mechanism. The check valve mechanism allows a lubricant to flow into the lubricant port 902 but does not allow the lubricant to flow in a reverse flow direction from the lubricant port.

In an operation 1015, the lubricant 912 is pressurized and thus delivered into the lubricant port 902. In an operation 1020, the pressurized lubricant 914 flows through the lubricant port 902 and into the top chamber 904 of the operating nut 202A, in an operation 1025. The top chamber 904 of the operating nut 202A forms a housing around the end of the operating stem 210. It should be noted that in the embodiment shown, the top chamber 904 is not threaded on the operating stem 210 and that a relatively small space or gap 906 remains between the threads of the operating stem and the wall of the top chamber. In other embodiments, one or more channels or grooves can be provided in the operating nut 202A or the operating stem 210 or both, for communicating the lubricant from the top chamber 904 to one or more side ports 908.

In an operation 1030, the pressurized lubricant 916 flows from the top chamber 904 through the relatively small space or gap 906 to the one or more side ports 908 in the operating nut 202A, in an operation 1035.

In an operation 1040, the pressurized lubricant 919 flows into a lubricant channel 909 between the operating nut 202A and the operating nut sleeve 206 in the fire hydrant 100. Seals 932 and 934 form respective upper boundary and lower boundary, to the lubricant channel 909 between the operating nut 202A and the operating nut sleeve 206, and the method operations can end. It should be understood that the operating nut sleeve 206 is an optional component and the lubricant channel 909 can be formed between the fire hydrant body 100 and the operating nut 202A.

The seals 932 and 934 can be o-rings or other suitable sealing mechanisms (e.g., compressible packing, grease or wax type seals and combinations thereof). The seals 932 and 934 can fit in corresponding grooves in the operating nut 202A and/or the operating nut sleeve 206. The seals 932 and 934 can be moved from the positions illustrated. By way of example, the top seal 932 can be moved to near the top of the operating nut in one or more alternate locations 932A, 932B. Similarly, the lower seal 934 can be moved to near the bottom of the operating nut in one or more alternate locations 934A, 934B. It should also be understood that more that two seals and/or seal types can be utilized. By way of example, tandem top seals can be provided in location 932A (e.g., rubber dust cap) and 932 (e.g., O-ring) and a compressible packing seal can be provided in location 934A.

The pressurized lubricant 919 can thus provide a lubricant film in the lubricant channel 909 between the operating nut 202A the operating nut sleeve 206. This lubricant film substantially prevents water from entering the lubricant channel 909. Thus substantially preventing the operating nut 202A from seizing, binding or corroding in the operating nut sleeve 206. As a result the operating nut 202A is more likely to remain operational (e.g., remain able to rotate and thus operate the operating stem 210) through various severe conditions such as freezing, pressurized water, hot and cold climates etc.

Hydrant Valve Seals

Figure 11B:
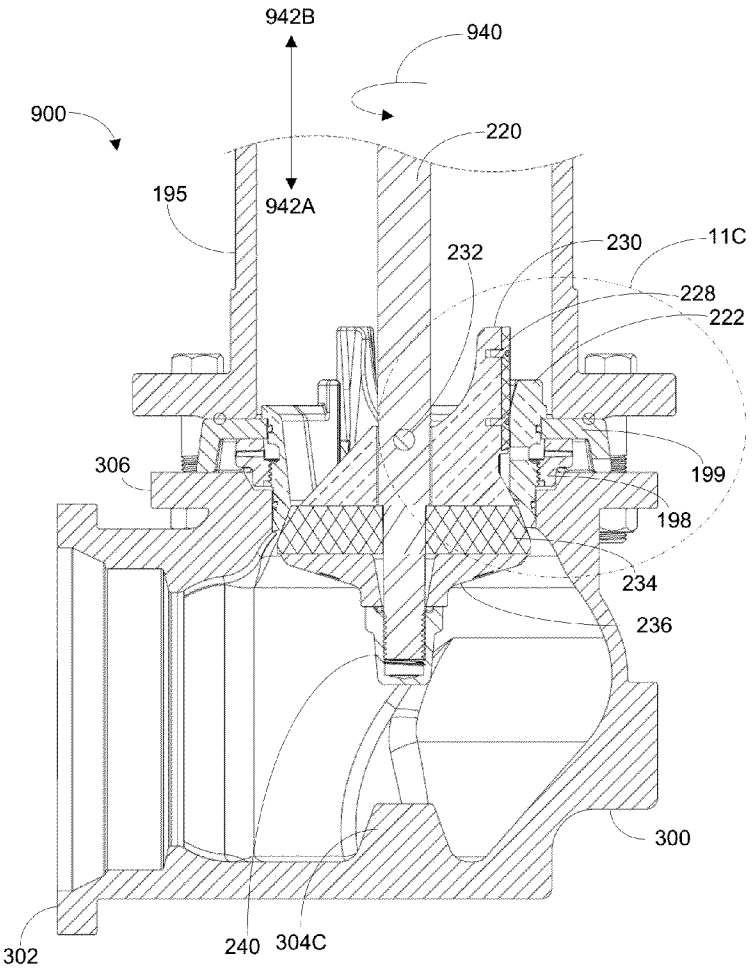
FIG. 11B is a sectional view 11B-11B (see FIG. 11A) of the inlet elbow and the valve control device in a closed position, in accordance with embodiments of the invention.
Figure 11A:
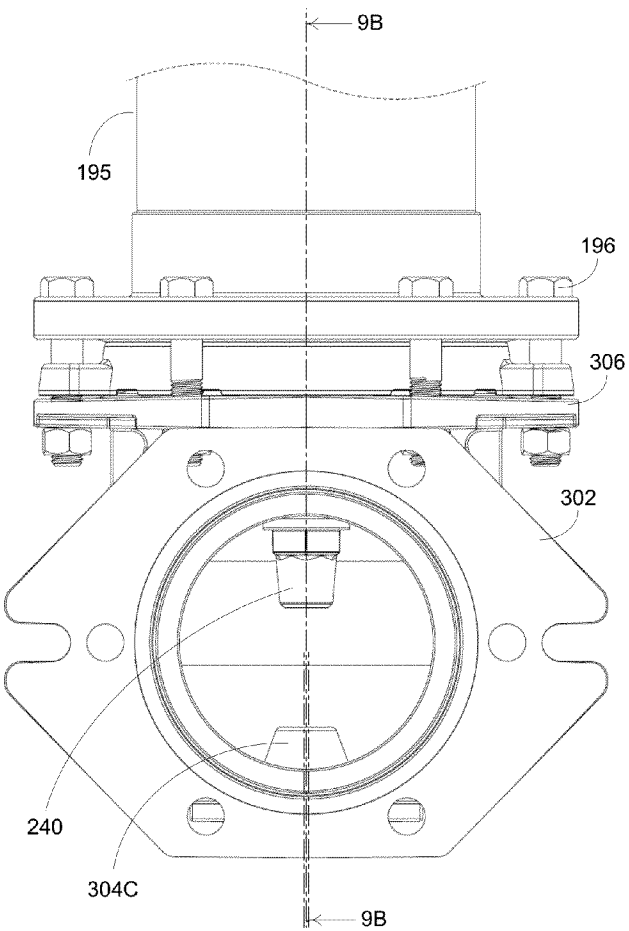
FIG. 11A is an inlet view of the inlet elbow and the valve control device, in accordance with embodiments of the invention.
Figure 11C:
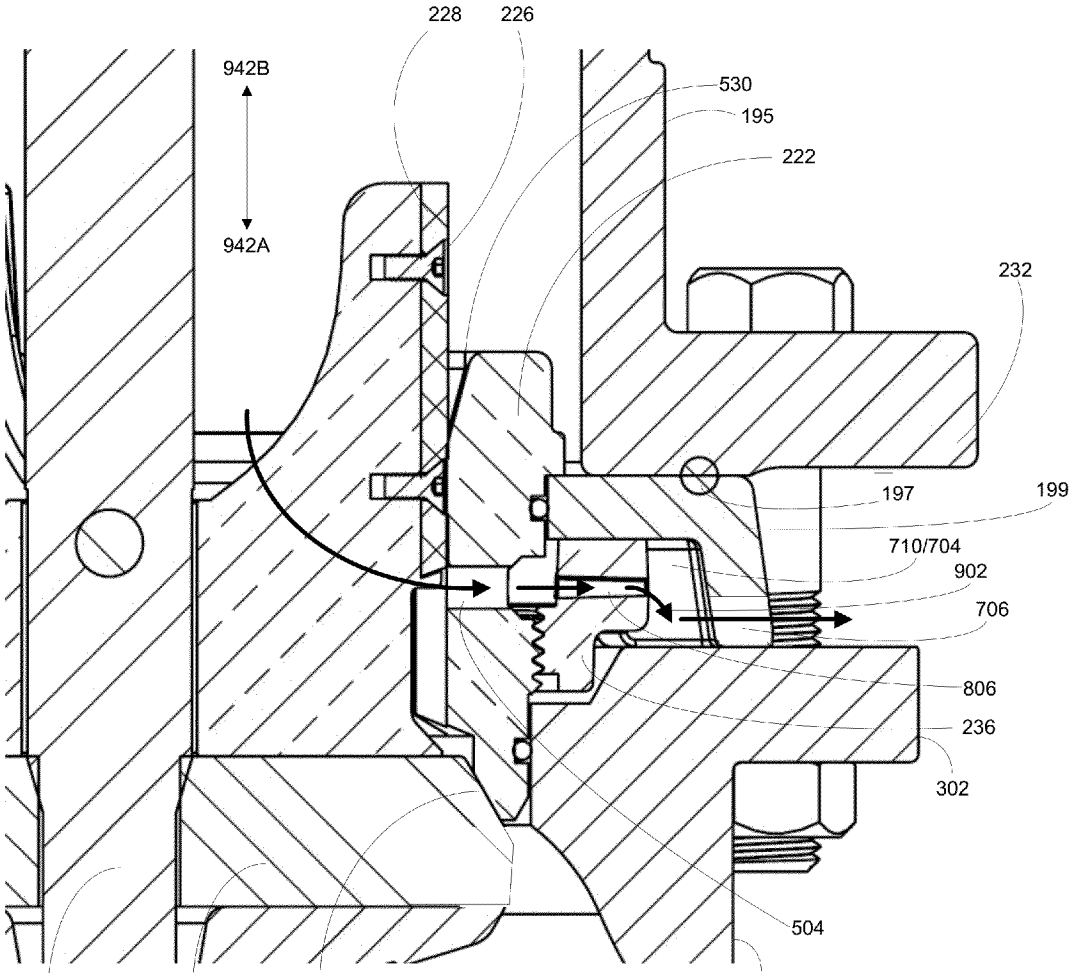
FIG. 11C is a detailed view of the inlet elbow and the valve control device in the closed position, in accordance with embodiments of the invention.

FIG. 11A is an inlet view of the inlet elbow 300 and the valve control device 200, in accordance with embodiments of the invention. FIG. 11B is a sectional view 11B-11B (see FIG. 11A) of the inlet elbow 300 and the valve control device 200 in a closed position, in accordance with embodiments of the invention. FIG. 11C is a detailed view of the inlet elbow 300 and the valve control device 200 in the closed position, in accordance with embodiments of the invention.

Figure 12A:
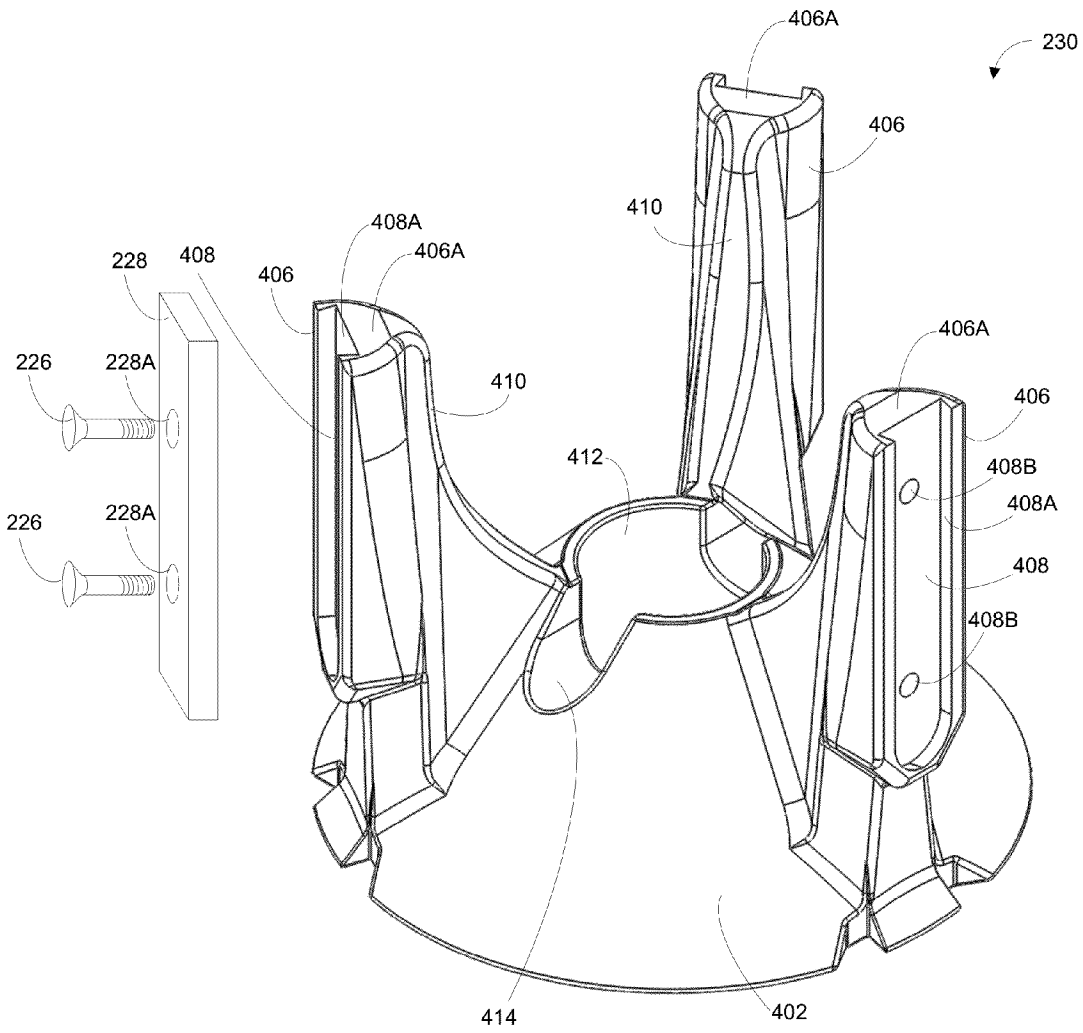
FIG. 12A is a perspective view of the valve top plate, in accordance with embodiments of the invention.
Figure 12E:
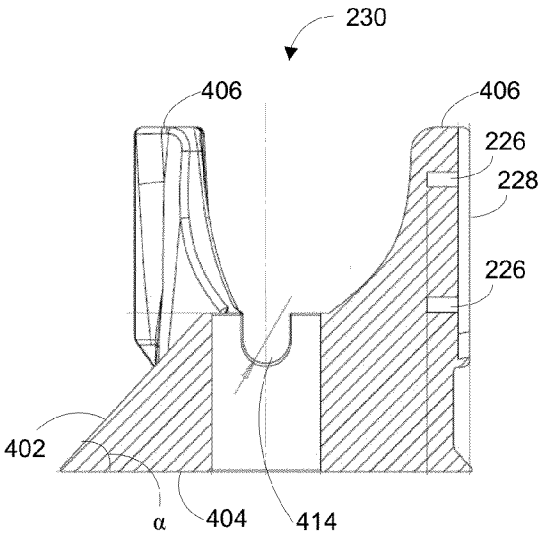
FIG. 12E is a sectional view 12E-12E (see FIG. 12D) of the valve top plate, in accordance with embodiments of the invention.
Figure 12D:
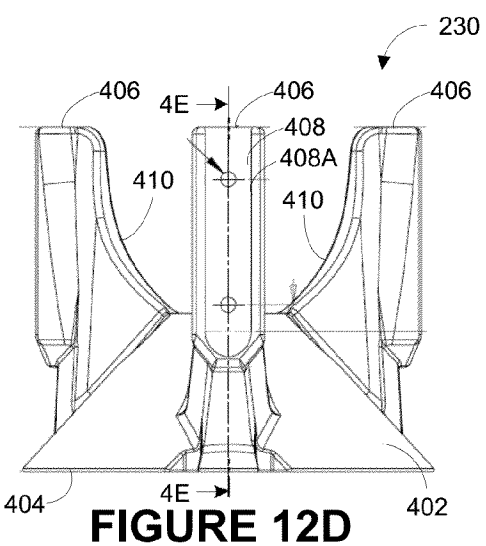
FIG. 12D is a side view of the valve top plate, in accordance with embodiments of the invention.
Figure 12C:
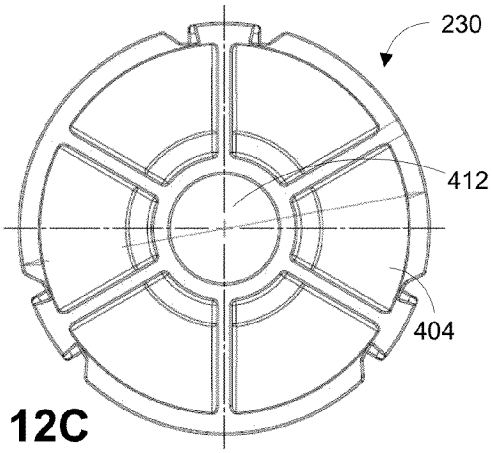
FIG. 12C is a bottom view of the valve top plate, in accordance with embodiments of the invention.
Figure 12B:
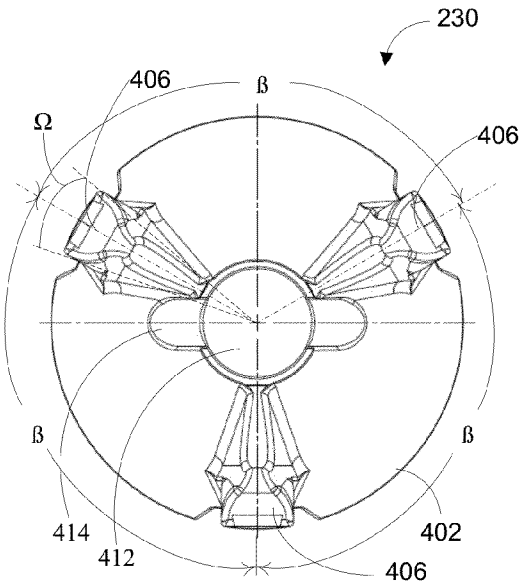
FIG. 12B is a top view of the valve top plate, in accordance with embodiments of the invention.
Figure 12F:
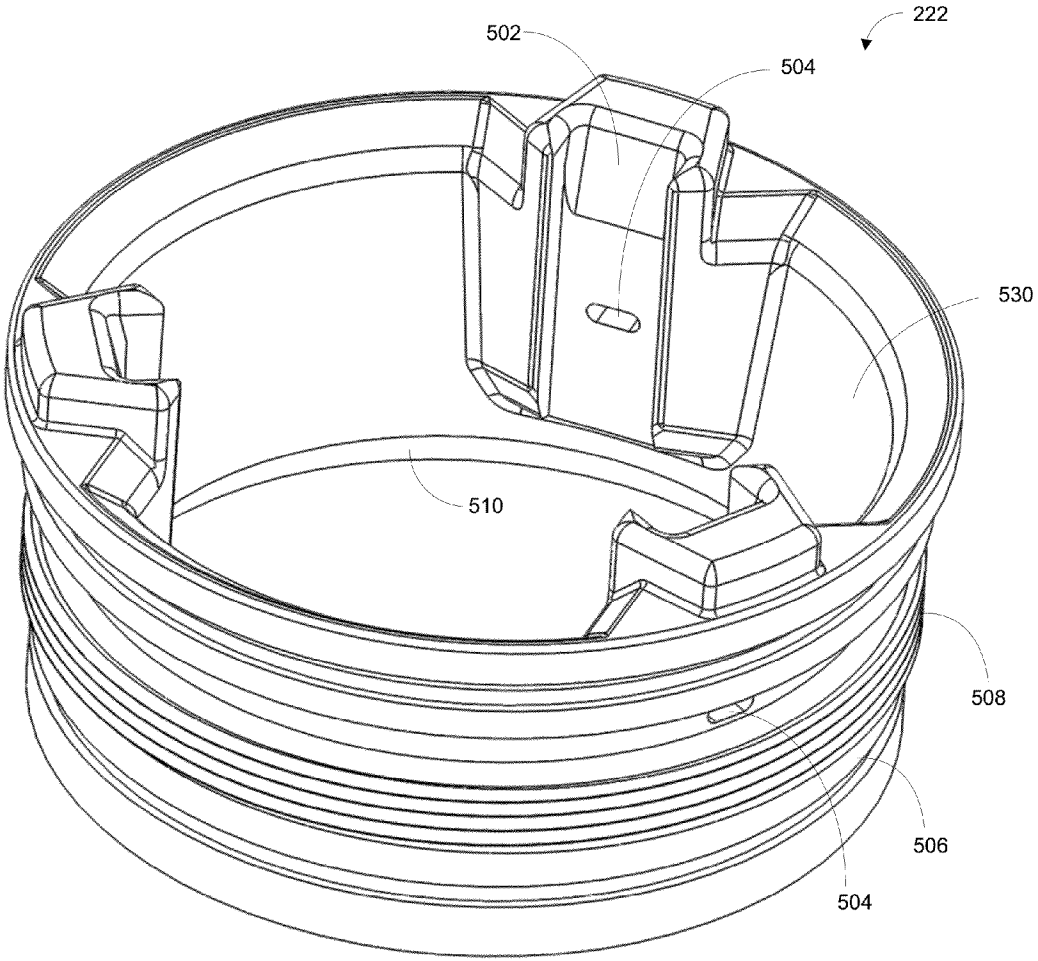
FIG. 12F is a perspective view of the valve seat ring, in accordance with embodiments of the invention.

FIG. 12A is a perspective view of the valve top plate 230, in accordance with embodiments of the invention. FIG. 12B is a top view of the valve top plate 230, in accordance with embodiments of the invention. FIG. 12C is a bottom view of the valve top plate 230, in accordance with embodiments of the invention. FIG. 12D is a side view of the valve top plate 230, in accordance with embodiments of the invention. FIG. 12E is a sectional view 12E-12E (see FIG. 12D) of the valve top plate 230, in accordance with embodiments of the invention. FIG. 12F is a perspective view of the valve seat ring 222, in accordance with embodiments of the invention. The valve top plate 230 has a substantially conical base 402 having an angle $\alpha$ of between about 20 degrees and about 60 degrees between the surface of the conical base and the substantially flat bottom surface 404 of the valve top plate 230 (see FIG. 12E).

The valve top plate 230 includes three substantially equally spaced stabilizer arms 406. It should be understood that the valve top plate 230 can include two, three, four or more stabilizer arms 406 and the three stabilizer arms represent only an exemplary embodiment and should not be viewed as being restrictive to only embodiments having three stabilizer arms.

The three stabilizer arms 406 can be spaced at angle $\beta$ of between about 90 degrees and about 135 degrees between the respective centerlines of the stabilizer arms (see FIG. 12B). It should be understood that while the valve top plate 230 is shown and described with three stabilizer arms, more than three (e.g., four or five or more) stabilizer arms could be included.

The stabilizer arms 406 have a substantially flat outer surface 408. The outer surfaces 408 fit into slots 502 of the valve seat ring 222 as will be described in more detail below. The stabilizer arms 406 have a substantially triangular cross section shape having an inner angle $\Omega$ that is opposite to the outer surfaces 408 (see FIG. 12B). The inner angle $\Omega$ is between about 20 degrees and about 45 degrees.

The valve top plate 230 includes replaceable inserts 228 installed on the outer surfaces 408 of the stabilizer arms 406 (see FIGS. 12A, 12E). The replaceable inserts 228 can be secured to the outer surfaces 408 with fasteners 226. The outer surfaces 408 can include recesses 408A that substantially surround the replaceable inserts 228 on one or more sides of the replaceable inserts.

The replaceable inserts 228 can be formed of a flexible and/or compressible resilient material. An exemplary resilient material is able to recoil or spring back into shape after bending, stretching, or being compressed. Exemplary flexible and/or compressible resilient materials include Delrin (i.e., acetal polyoxymethylene copolymer (POM)), polyethelyne oxide, poly-dimethyl acetal resin, ultra-high-molecular-weight polyethylene (UHMW) (e.g., a polyolefin with polymer chains having a parallel orientation of about 90% and a level of crystallinity of up to 90 percent) and other suitable flexible and/or compressible resilient materials.

When the operating stem 220 moves in direction 942B which also moves the valve control device 200 in direction 942B to a closed position, the valve top plate 230 fully uncovers the drain holes 504 in the valve seat ring 222. Uncovering the drain holes 504 in the valve seat ring 222 allows water in the standpipe 195 to drain from the standpipe and out a 902.

By way of example, the water flows out the drain holes 504 and the drain ports 806 in the drain ring 198 and the notches 704, outlet notches 706 and drain channel 710 in the saturation ring 199, thus draining the standpipe 195.

When the operating stem 220 moves in direction 942A which also moves the valve control device 200 in direction 942A to an open position, the valve top plate 230 fully covers the drain holes 504 in the valve seat ring 222 and the water from the inlet elbow 300 pressurizes the standpipe 195. Covering the drain holes 504 in the valve seat ring 222 prevents water in the standpipe 195 from draining from the standpipe. Thus more water is delivered to the fire hydrant user and less water is wasted.

Figure 13A:
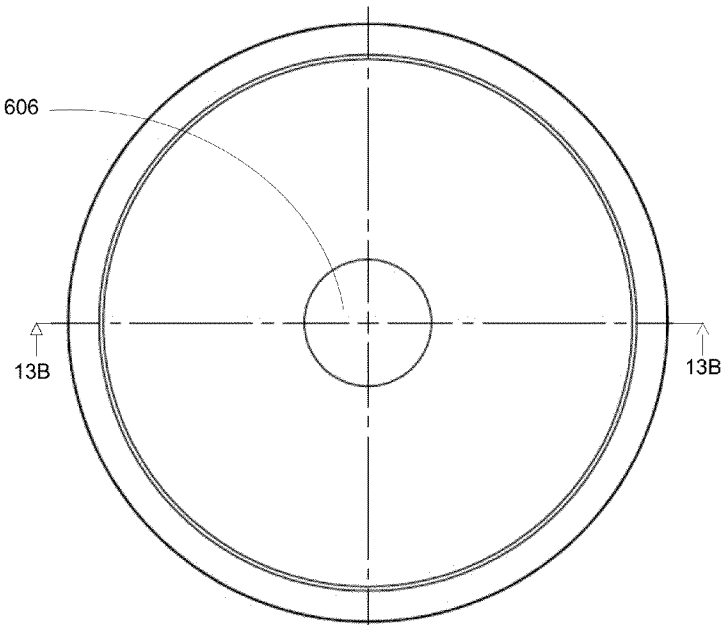
FIG. 13A is a top view of the valve bottom plate, in accordance with embodiments of the invention.
Figure 13B:
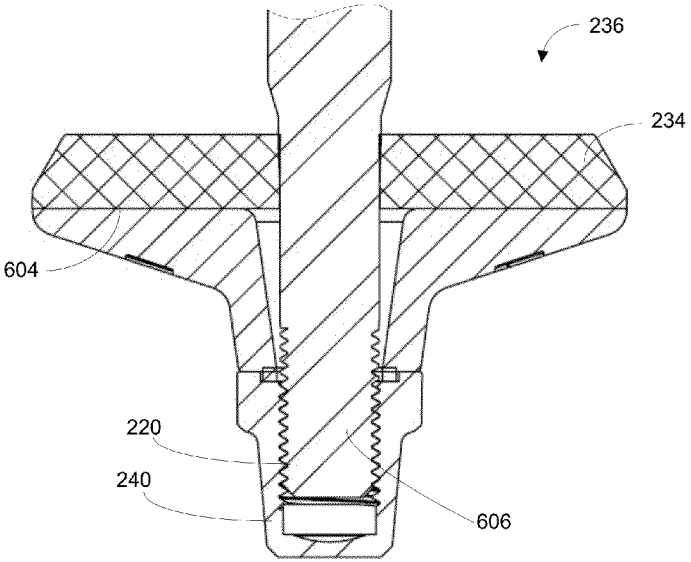
FIG. 13B is a sectional view 13B-13B (see FIG. 13A) of the valve bottom plate, in accordance with embodiments of the invention.

FIG. 13A is a top view of the valve bottom plate 236, in accordance with embodiments of the invention. FIG. 13B is a sectional view 13B-13B (see FIG. 13A) of the valve bottom plate 236, in accordance with embodiments of the invention. As shown in FIG. 13B, the valve bottom plate 236 has a valve seat 604. The valve seat 604 receives and supports the seat valve seal 234. The seat valve seal 234 is secured between the valve bottom plate 236 and the bottom surface 404 of the valve top plate 230.

The valve bottom plate 236 also includes a valve bottom plate central channel 606. The lower operating stem 220 (see FIG. 2) passes through the valve top central channel 412 of the valve top plate 230 and the valve seat seal 234 and through the valve bottom plate central channel 606. The valve bottom plate 236, the valve seat seal 234 and the valve top plate 230 are secured to the lower operating stem 220 between the stem pin groove 414 and the bottom plate nut 240.

The valve control device 200 moves in directions 942A and 942B as the lower portion of the operating stem 220 moves in the corresponding direction. By way of example the operating stem 220 moves in direction 942A which also moves the valve control device 200 in direction 942A to an open position (e.g., forms a gap between the seat valve seal 234 and the valve seat 510 in the valve seat ring 222). Similarly, when the operating stem 220 moves in direction 942B which also moves the valve control device 200 in direction 942B to a closed position (e.g., closes the gap between the seat valve seal 234 and the valve seat 510 in the valve seat ring 222).

The seat valve seal 234 is formed of a flexible and/or compressible resilient material and can therefore be somewhat deformed as it seats in the valve seat 510 thus forming a very tight seal. Thus preventing leakage of pressurized water from the inlet elbow 300 to the standpipe 195. Typically, if water leaks across the valve seat 510, the standpipe 195 can become pressurized. A pressurized standpipe 195 can prevent the locking cap 106 and/or the side caps 108A and 108B from being removed from the fire hydrant body 100. Exemplary flexible and/or compressible resilient materials include Delrin (i.e., acetal polyoxymethylene copolymer (POM)), polyethelyne oxide, poly-dimethyl acetal resin, ultra-high-molecular-weight polyethylene (UHMW) (e.g., a polyolefin with polymer chains having a parallel orientation of about 90% and a level of crystallinity of up to 90 percent) and other suitable flexible and/or compressible resilient materials.

In summary, the present invention provides a sprinkler cap for a fire hydrant that includes, among other features, sprinkler ports and a sprinkler cap control lock. The present invention provides a system and method for lubricating the operating nut and improved sealing surfaces in the fire hydrant valves. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A fire hydrant comprising:

a sprinkler cap having a plurality of sprinkler ports; and a sprinkler cap control lock disposed in a tongue that extends from the sprinkler cap, the tongue being disposed in a valve access channel defined in a top side of a head of the fire hydrant, wherein the sprinkler cap control lock covers and prevents access to an operating nut disposed in the valve access channel, the operating nut is substantially perpendicular to the top side of the head, wherein the valve access channel is a recessed portion in the top side of the head of the fire hydrant extending from a first side of the fire hydrant toward the operating nut, the first side of the fire hydrant is substantially perpendicular to the top side of the head and wherein the valve access channel includes a first valve access channel side and a second valve access channel side and the sprinkler cap control lock including:

a first sprinkler cap control lock side is substantially parallel and close-fitting to the first valve access channel side; and a second sprinkler cap control lock side is substantially parallel and close-fitting to the second valve access channel side.

2. The fire hydrant of claim 1, wherein the sprinkler cap is a locking sprinkler cap.

3. The fire hydrant of claim 2, wherein the sprinkler cap control lock locks to the tongue of the locking sprinkler cap.

4. The fire hydrant of claim 1, wherein the sprinkler cap is a side cap.

5. The fire hydrant of claim 1, wherein the valve access channel prevents access to the first sprinkler cap control lock side and the second sprinkler cap control lock side.

6. The fire hydrant of claim 1, wherein the tongue is coupled to the sprinkler cap.

7. The fire hydrant of claim 1, wherein the tongue is coupled to the sprinkler cap and extends substantially perpendicularly from the sprinkler cap.

8. The fire hydrant of claim 1, wherein the valve access channel provides a route to drain water away from the operating nut.

9. A fire hydrant comprising:

a locking cap having a tongue; and a sprinkler cap control lock disposed in the tongue, wherein the sprinkler cap control lock covers and prevents access to an operating nut disposed in a valve access channel, the operating nut is substantially perpendicular to a top side of the head, and wherein the sprinkler cap control lock is disposed in a valve access channel defined as a recessed portion in the top side of the head of the fire hydrant extending from a first side of the fire hydrant toward the operating nut, the first side of the fire hydrant is substantially perpendicular to the top side of the head and wherein the valve access channel includes a first valve access channel side and a second valve access channel side and the sprinkler cap control lock including:

a first sprinkler cap control lock side is substantially parallel and close-fitting to the first valve access channel side; and a second sprinkler cap control lock side is substantially parallel and close-fitting to the second valve access channel side.

10. The fire hydrant of claim 9, wherein the locking cap includes a plurality of sprinkler ports.

11. The fire hydrant of claim 9, further comprising a side cap including a plurality of sprinkler ports.

12. The fire hydrant of claim 9, wherein the valve access channel prevents access to the first sprinkler cap control lock side and the second sprinkler cap control lock side.

13. The fire hydrant of claim 9, wherein the tongue is coupled to the sprinkler cap.

14. The fire hydrant of claim 9, wherein the tongue is coupled to the sprinkler cap and extends substantially perpendicularly from the sprinkler cap.

15. A fire hydrant comprising:

a locking cap having a tongue that extends therefrom, the tongue having an opening at a distal end thereof; and a sprinkler cap control lock including a key operated locking mechanism, the sprinkler cap control lock being disposed in the opening in the locking cap tongue, wherein the tongue and the sprinkler cap control lock are disposed in a valve access channel defined as a recessed portion in the top of the head of the fire hydrant extending from the first side of the fire hydrant across a portion of the top of the head, the first side of the fire hydrant is substantially perpendicular to a top side of the head and the opening in the tongue is substantially perpendicular to the top side of the head, wherein the valve access channel includes a first valve access channel side and a second valve access channel side and the sprinkler cap control lock including:

a first sprinkler cap control lock side is substantially parallel and close-fitting to the first valve access channel side; and a second sprinkler cap control lock side is substantially parallel and close-fitting to the second valve access channel side.

16. The fire hydrant of claim 15, wherein the locking cap includes a plurality of sprinkler ports.

17. The fire hydrant of claim 15, further comprising a side cap including a plurality of sprinkler ports.

18. The fire hydrant of claim 15, wherein the valve access channel prevents access to the first sprinkler cap control lock side and the second sprinkler cap control lock side.

19. The fire hydrant of claim 15, wherein the tongue is coupled to the sprinkler cap.

20. The fire hydrant of claim 15, wherein the tongue is coupled to the sprinkler cap and extends substantially perpendicularly from the sprinkler cap.

* * * * *